US009535369B2

(12) United States Patent
Kamura et al.

(10) Patent No.: US 9,535,369 B2
(45) Date of Patent: Jan. 3, 2017

(54) DEVELOPER SUPPLY CONTAINER AND DEVELOPER SUPPLYING SYSTEM

(71) Applicant: CANON KABUSHIKI KAISHA, Tokyo (JP)

(72) Inventors: Akihito Kamura, Kashiwa (JP); Ayatomo Okino, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/856,956

(22) Filed: Sep. 17, 2015

(65) Prior Publication Data

US 2016/0004188 A1 Jan. 7, 2016

Related U.S. Application Data

(63) Continuation of application No. PCT/JP2013/060413, filed on Mar. 29, 2013.

(30) Foreign Application Priority Data

Mar. 19, 2013 (JP) ..... 2013-056444

(51) Int. Cl.
*G03G 15/08* (2006.01)

(52) U.S. Cl.
CPC ..... *G03G 15/0877* (2013.01); *G03G 15/0837* (2013.01); *G03G 15/0839* (2013.01); *G03G 15/0872* (2013.01); *G03G 2215/0678* (2013.01)

(58) Field of Classification Search
CPC ..... G03G 15/0837; G03G 15/0839
See application file for complete search history.

(56) References Cited

U.S. PATENT DOCUMENTS 2,028,718 A * 1/1936 Heine ..... F16C 29/04 384/49
5,235,354 A 8/1993 Larson
(Continued)

FOREIGN PATENT DOCUMENTS

JP H04-143781 A 5/1992
JP H04-505899 A 10/1992
(Continued)

OTHER PUBLICATIONS

International Search Report and Written Opinion of the International Searching Authority in International Patent Application No. PCT/JP2013/060413, dated May 14, 2013 (translation).

*Primary Examiner* — Minh Phan
*Assistant Examiner* — Leon W Rhodes, Jr.
(74) *Attorney, Agent, or Firm* — Fitzpatrick, Cella, Harper & Scinto

(57) ABSTRACT

A developer supply container and a developer supplying system include a feeding portion 2*c* for feeding a developer T in a developer accommodating portion 2 toward a developer discharging portion 4*c* in accordance with rotation, a gear portion 2*d* for receiving a rotational force for rotating a feeding portion 2*c*, a pump portion 3*a* provided to act at least toward the developer discharging portion 4*c* and having a volume with changes with reciprocation, a drive converting portion for converting the rotational force inputted to the gear portion 2*d* into a force for operating the pump portion 3*a*, a reciprocating member 3*b* provided at the drive converting portion and reciprocable to convert to the rotational force into a force for operating the pump portion 3*a*, a rotation regulating portion 3*f* for regulating movement in a direction crossing with a direction in which the reciprocating member 3*b* reciprocates, an elastically deformable urging portion 3*g*1, 3*g*2, provided on the reciprocating
(Continued)

(a)

(b)

member 3*b*, for urging the reciprocating member 3*b* toward the rotation regulating portion 3*f*.

6 Claims, 15 Drawing Sheets

(56) References Cited

U.S. PATENT DOCUMENTS

| | | | | |
|---|---|---|---|---|
| 5,446,478 | A | 8/1995 | Larson | |
| 5,805,353 | A * | 9/1998 | Ichino | G02B 7/10 359/699 |
| 5,886,832 | A * | 3/1999 | Ihara | G02B 7/04 359/700 |
| 7,050,728 | B2 | 5/2006 | Minagawa et al. | |
| 8,000,614 | B2 | 8/2011 | Okino et al. | |
| 8,565,649 | B2 | 10/2013 | Murakami et al. | |
| 2009/0169266 | A1 | 7/2009 | Uehara | |
| 2012/0014713 | A1 | 1/2012 | Murakami et al. | |
| 2012/0014722 | A1 | 1/2012 | Okino et al. | |
| 2013/0209134 | A1 | 8/2013 | Okino et al. | |
| 2013/0209140 | A1 | 8/2013 | Murakami et al. | |
| 2014/0016967 | A1 | 1/2014 | Murakami et al. | |
| 2014/0153974 | A1 | 6/2014 | Jimba et al. | |
| 2014/0169836 | A1 | 6/2014 | Nagashima et al. | |
| 2014/0233986 | A1 | 8/2014 | Murakami et al. | |

FOREIGN PATENT DOCUMENTS

| | | | |
|---|---|---|---|
| JP | H06-130812 | A | 5/1994 |
| JP | H06-250520 | A1 | 9/1994 |
| JP | 2009-128429 | A | 6/2009 |
| JP | 2009-175703 | A | 8/2009 |
| WO | 2010/114154 | A1 | 3/2010 |
| WO | 2010/114153 | A1 | 10/2010 |
| WO | 2012/043875 | A1 | 4/2012 |
| WO | 2012/043876 | A1 | 4/2012 |
| WO | 2012/169657 | A1 | 12/2012 |
| WO | 2013/031996 | A1 | 3/2013 |

* cited by examiner (a)

(b)

(a)

(b)

DEVELOPER SUPPLY CONTAINER AND DEVELOPER SUPPLYING SYSTEM

FIELD OF THE INVENTION

The present invention relates to a developer supply container detachably mountable to a developer supplying apparatus and a developer supplying system comprising them. The developer supply container and the developer supplying system are used with an image forming apparatus such as a copying machine, a facsimile machine, a printer or a complex machine having functions of a plurality of such machines.

BACKGROUND ART

Conventionally, an image forming apparatus such as an electrophotographic copying machine uses a developer of fine particles. In such an image forming apparatus, the developer is supplied from the developer supply container in response to consumption thereof resulting from image forming operation.

Such a developer supply container is disclosed in Japanese Laid-open Patent Application 2013-015826, for example.

The device disclosed in Japanese Laid-open Patent Application 2013-015826 employs a drive converting mechanism for converting a rotational force inputted from the image forming apparatus to the developer supply container into a reciprocation force in a rotational axis direction.

In addition, the device disclosed in Japanese Laid-open Patent Application 2013-015826 employees a reciprocating member reciprocable in the rotation axial direction, the reciprocating member and being engaged with the drive converting mechanism for converting the rotational force inputted from the image forming apparatus to the developer supply container.

SUMMARY OF THE INVENTION

Problem to be Solved by the Invention

In the structure of Japanese Laid-open Patent Application 2013-015826, a small gap is provided between the reciprocating member and a regulating portion for preventing the movement in the rotational moving direction to limit it only to the reciprocation in the rotational axis direction, in order to make easier the movement of the reciprocating member in the rotational axis direction. With this structure, a force in the rotational moving direction is applied to a part of the reciprocating member for converting the rotational force into the reciprocation. By the collision between the reciprocating member and the regulating portion may result in contact noise, depending on the strength of the force in the rotational direction.

Accordingly, the present invention is intended to solve the problem, and it is an object of the present invention to provide a developer supply container and a developer supplying system with which the contact noise produced by the contact between the reciprocating member and the regulating portion is reduced.

Means for Solving the Problem

The present invention provides a developer supply container detachably mountable to a developer supplying apparatus, said developer supply container comprising a developer accommodating portion for accommodating a developer; a developer discharging portion provided with a discharge opening for discharging the developer; a feeding portion for feeding the developer in said developer accommodating portion toward said developer discharging portion with rotation thereof; a drive receiving portion for receiving a rotational force for rotating said feeding portion; a pump portion provided to act at least toward said developer discharging portion and having a volume which changes with reciprocation; a drive converting portion for converting the rotational force inputted to said drive receiving portion into a force for operating said pump portion; a reciprocating member provided at said drive converting portion and reciprocable to convert the rotational force into a force for operating said pump portion; a regulating portion for regulating movement in a direction crossing with a direction in which said reciprocating member reciprocates; and an elastically deformable urging portion, provided on said reciprocating member, for urging said reciprocating member toward said regulating portion.

Effects of the Invention

According to the present invention, the contact noise produced by the contact between the reciprocating member and the regulating portion can be reduced.

Figure 2:
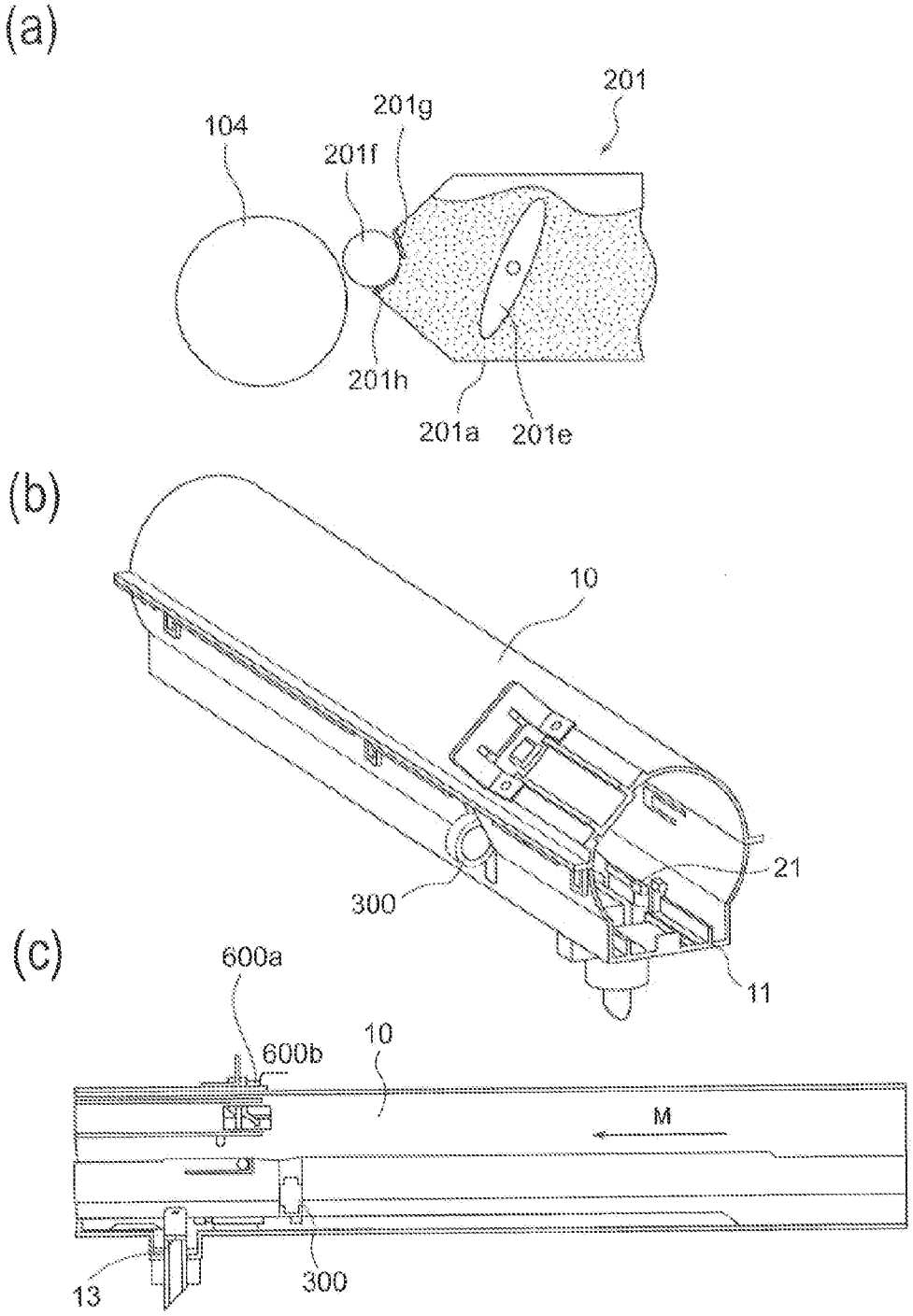

Part (a) of FIG. 2 is a partial schematic sectional view illustrating a structure of the developer supplying apparatus, part (b) is a schematic perspective view illustrating a structure of a mounting portion, and part (c) it is a schematic sectional view illustrating the structure of the mounting portion.

Figure 3:
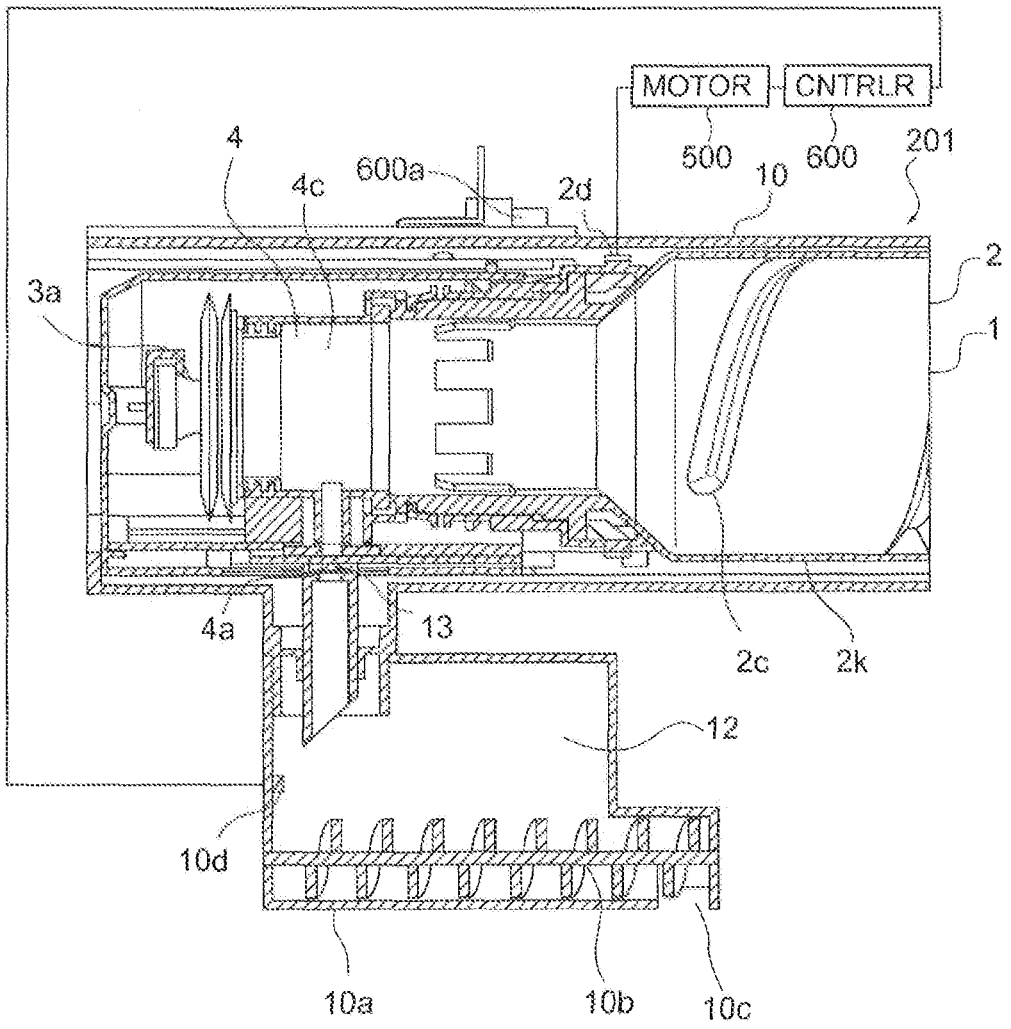

FIG. 3 is a schematic sectional view illustrating structures of the developer supply container and in the developer supplying apparatus.

Figure 4:
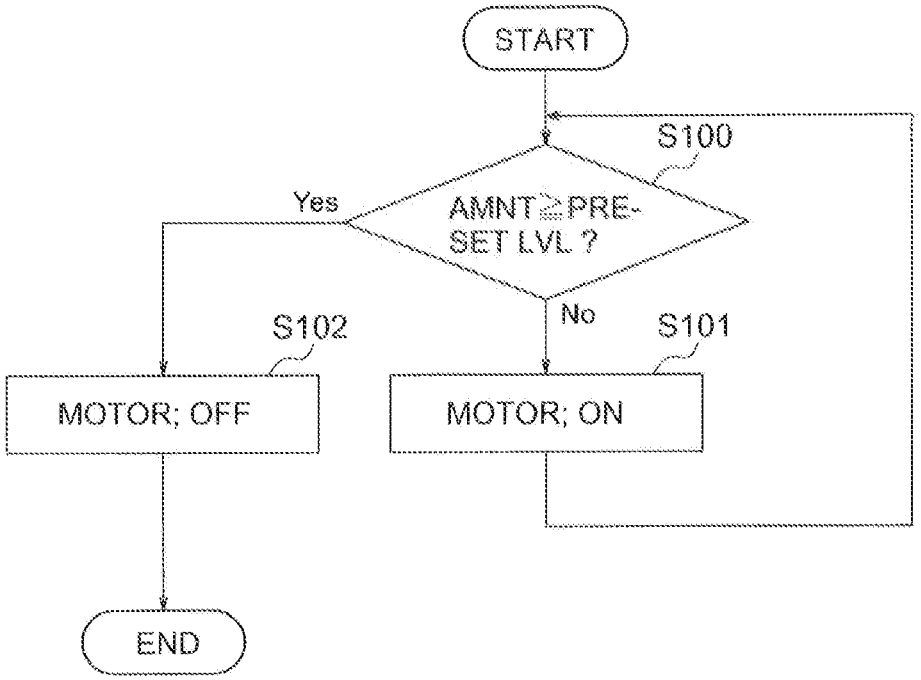

FIG. 4 is a flow chart illustrating the operation of the developer supply.

Figure 5:
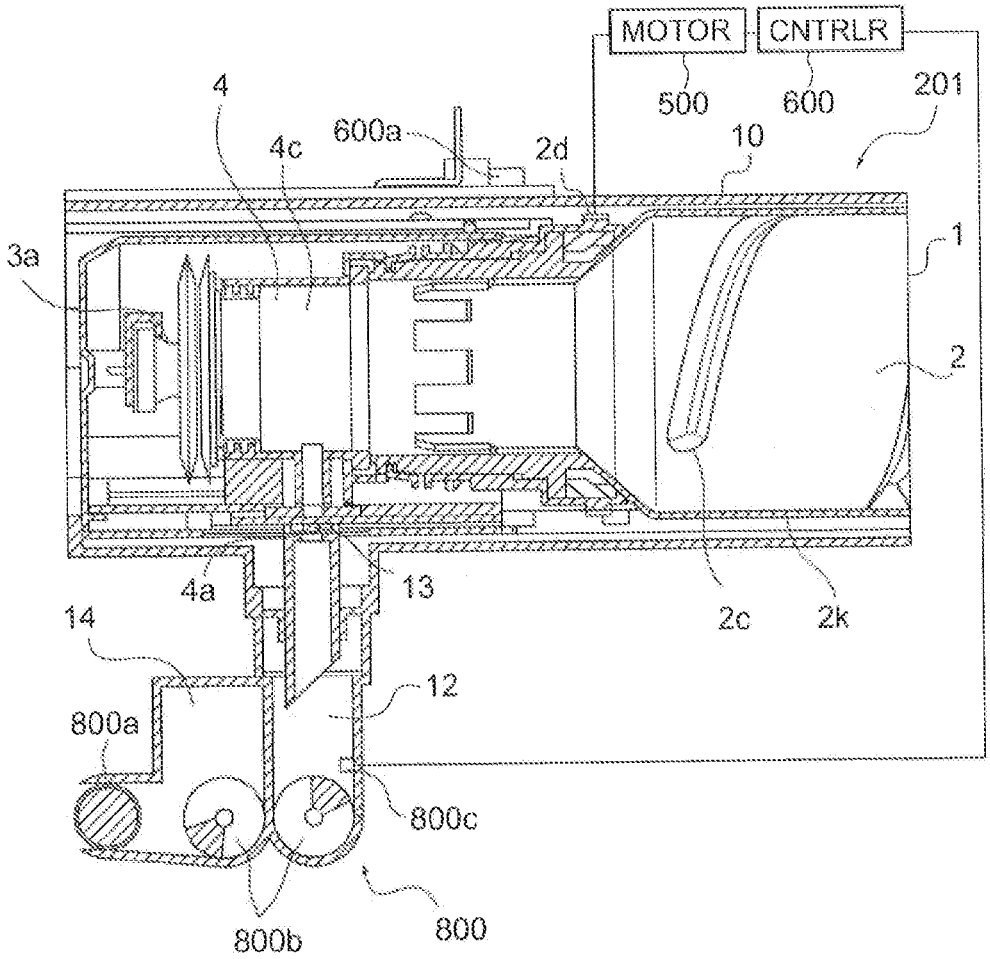

FIG. 5 is an enlarged sectional view illustrating a structure of a modified example of the developer supplying apparatus.

Figure 6:
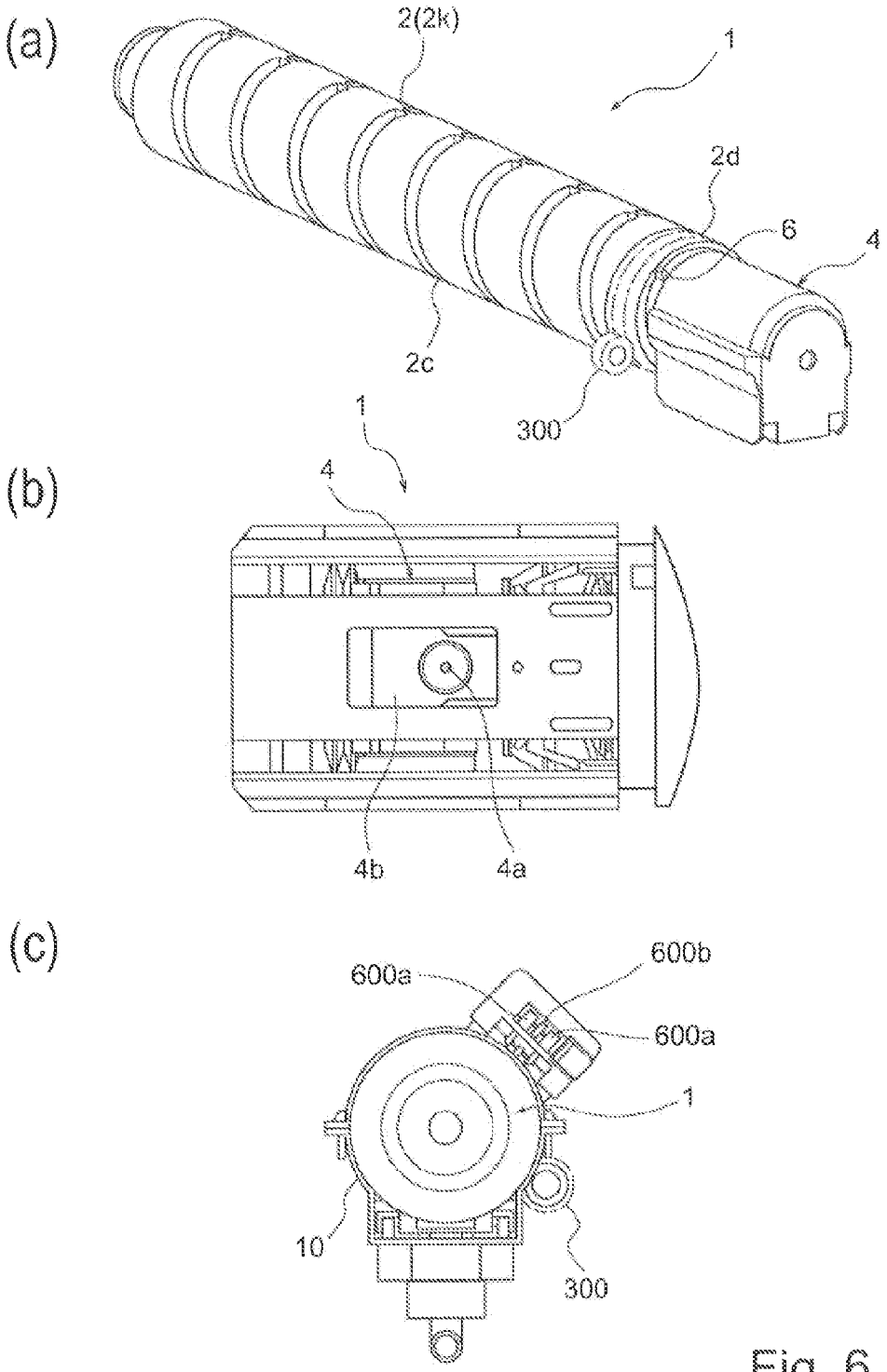

Part (a) of FIG. 6 is a schematic perspective view illustrating a structure of the developer supply container, (b) is a partial enlarged view illustrating the structure around the discharge opening, (c) is a substantial front view illustrating a state in which the developer supply container is mounted to the mounting portion of the developer supplying apparatus.

Figure 7:
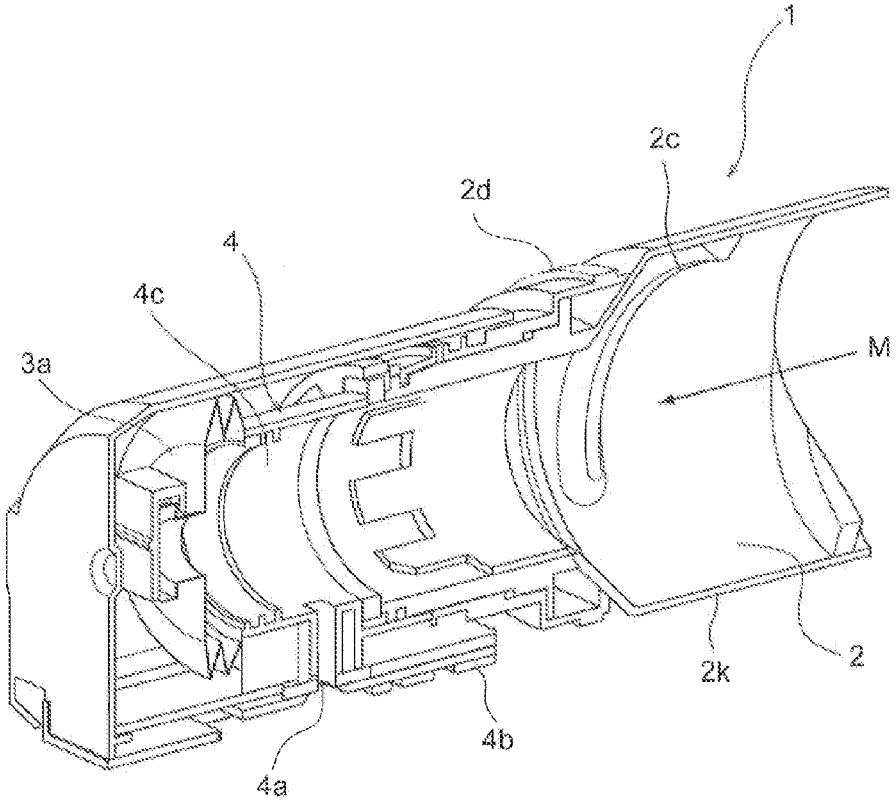

FIG. 7 is a sectional perspective view illustrating a structure of the developer supply container.

Figure 8:
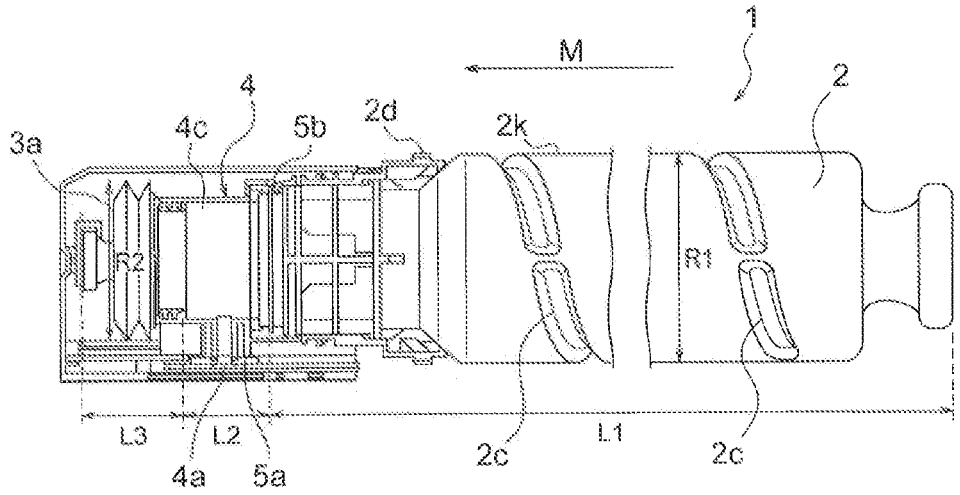
Figure 8:
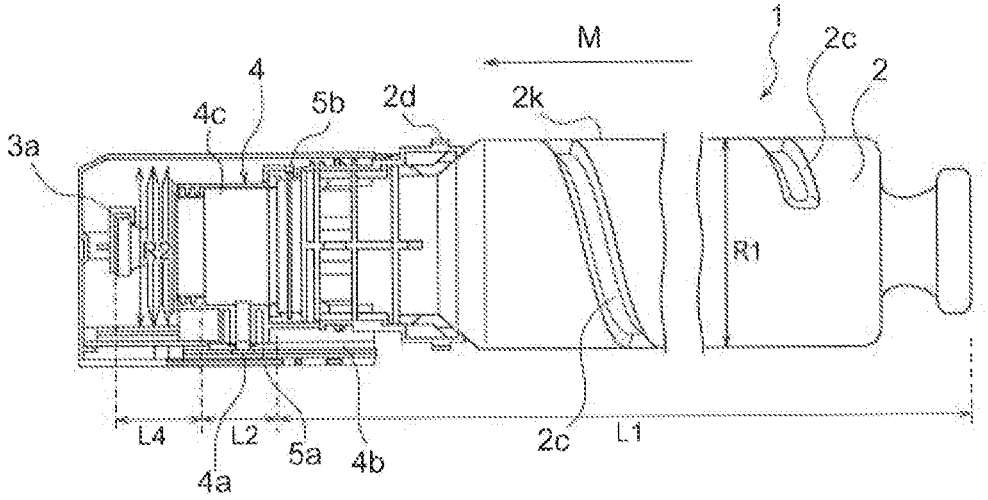

Part (a) of FIG. 8 is a partially sectional view illustrating a state in which the pump portion is expanded to the maximum usable limit, (b) is a partially sectional view illustrating a state in which the pump portion is contracted to the maximum usable limit.

Figure 9:
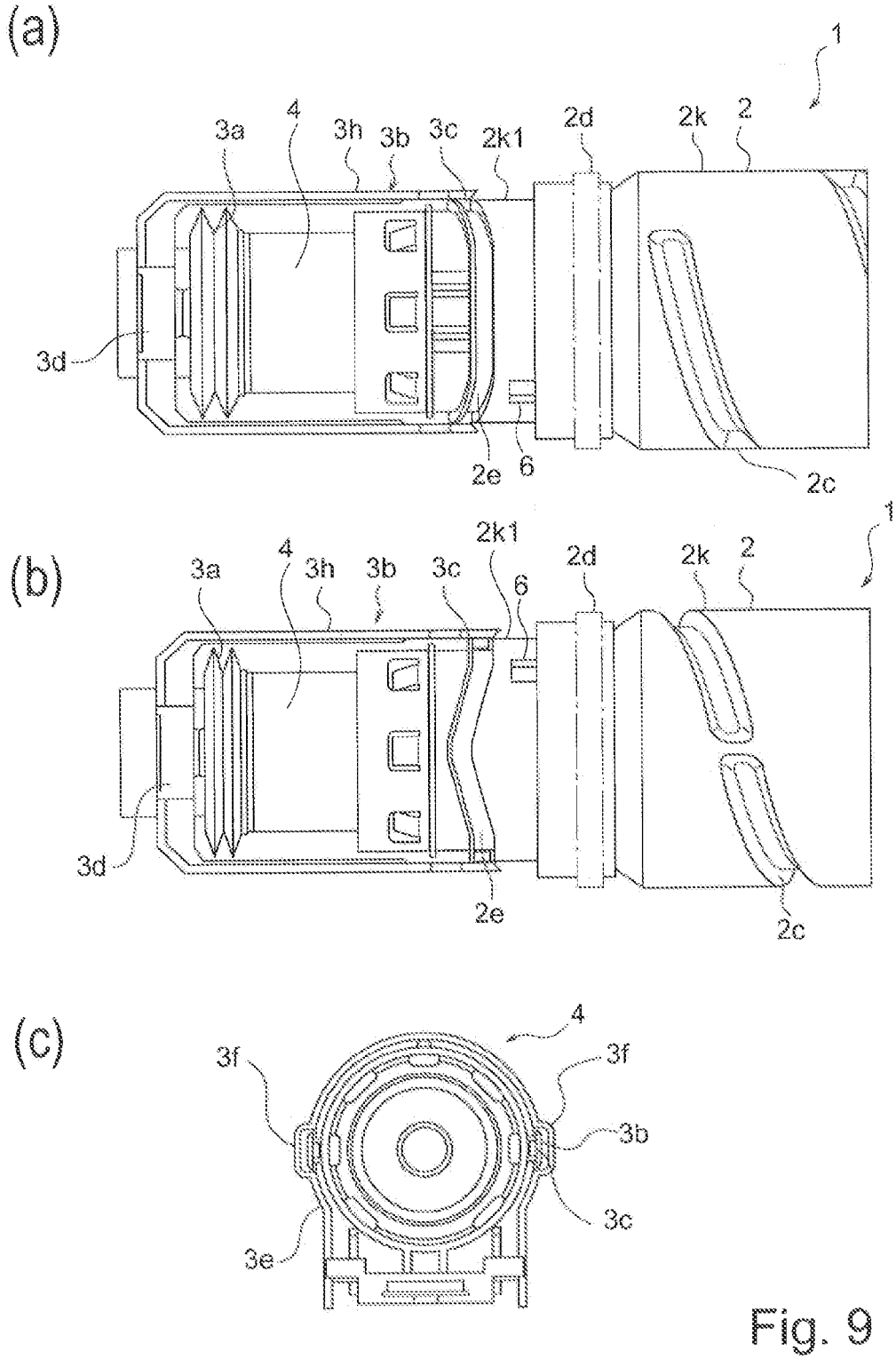

Part (a) of FIG. 9 is a partially sectional view illustrating a state in which the pump portion is expanded to the maximum usable limit, (b) is a partially sectional view illustrating a state in which the pump portion is contracted to the maximum usable limit, (c) is a partially sectional view of the pump portion as seen from a front side.

Figure 10:
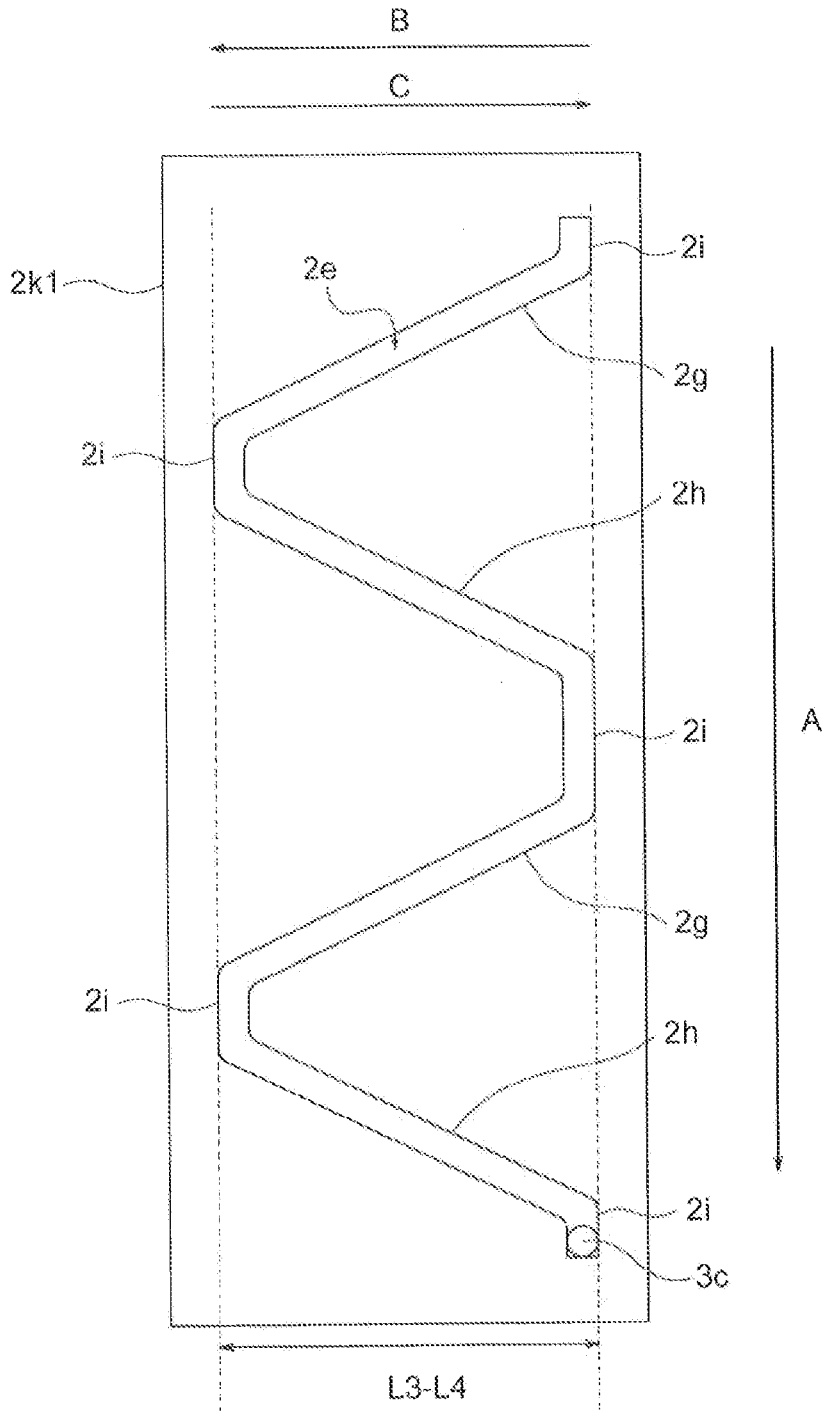

FIG. 10 is a development illustrating a configuration of a cam groove of the developer supply container.

Figure 11:
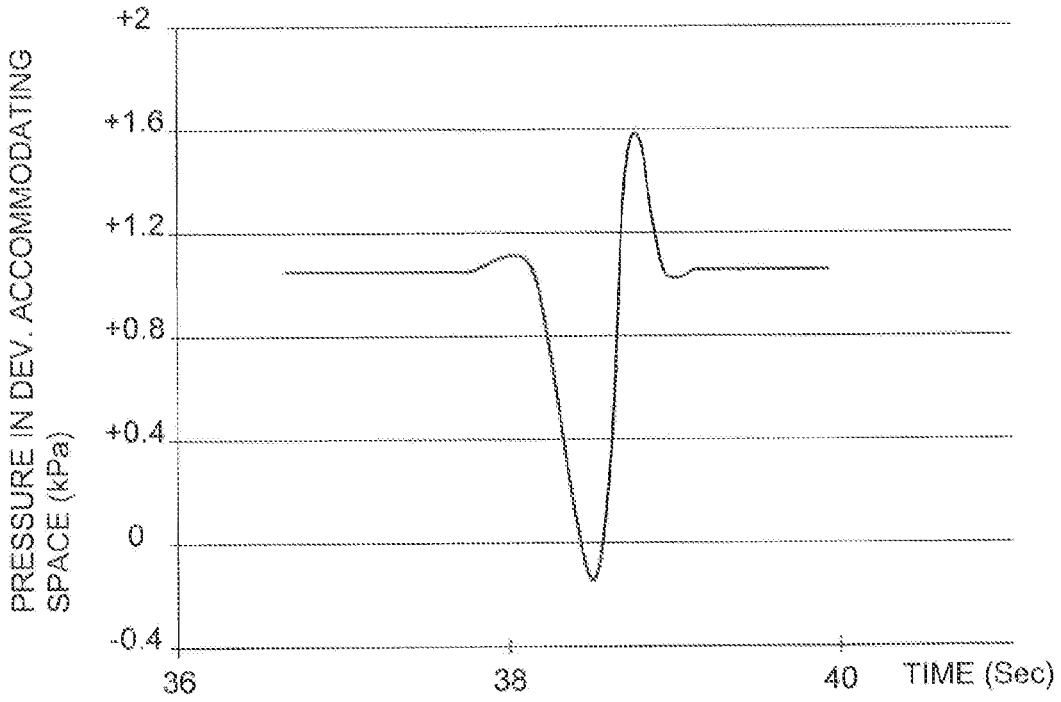

FIG. 11 illustrates a change of an internal pressure of the developer supply container.

Figure 12:
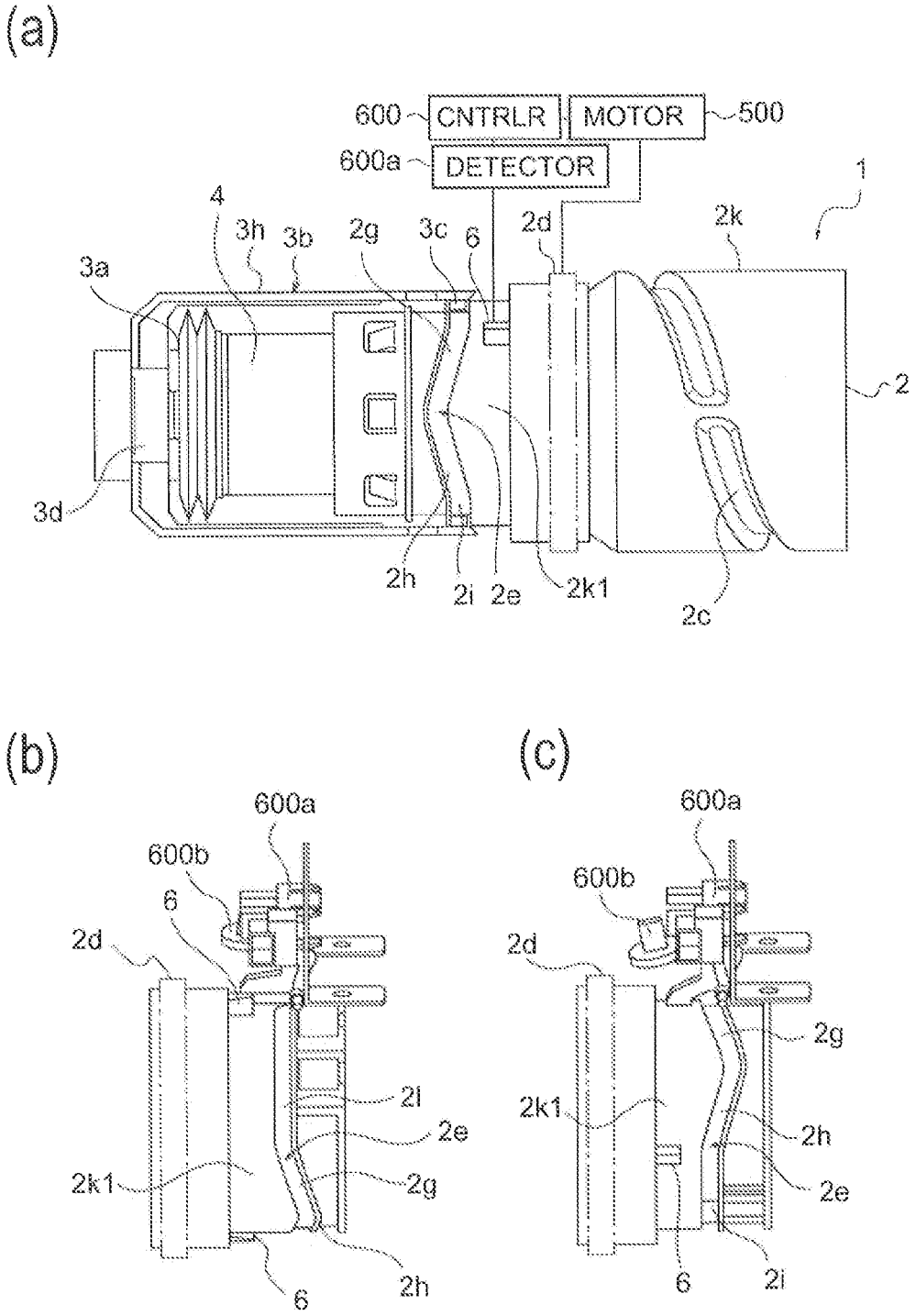

Part (a) of FIG. 12 is a schematic sectional view illustrating structures of the developer supply container and the developer supplying apparatus, (b) is a partially sectional view illustrating a state of an instructing portion when the driving motor is rotating, (c) is a partially sectional view illustrating a state of the instructing portion when the driving motor stop is at rest.

Figure 13:
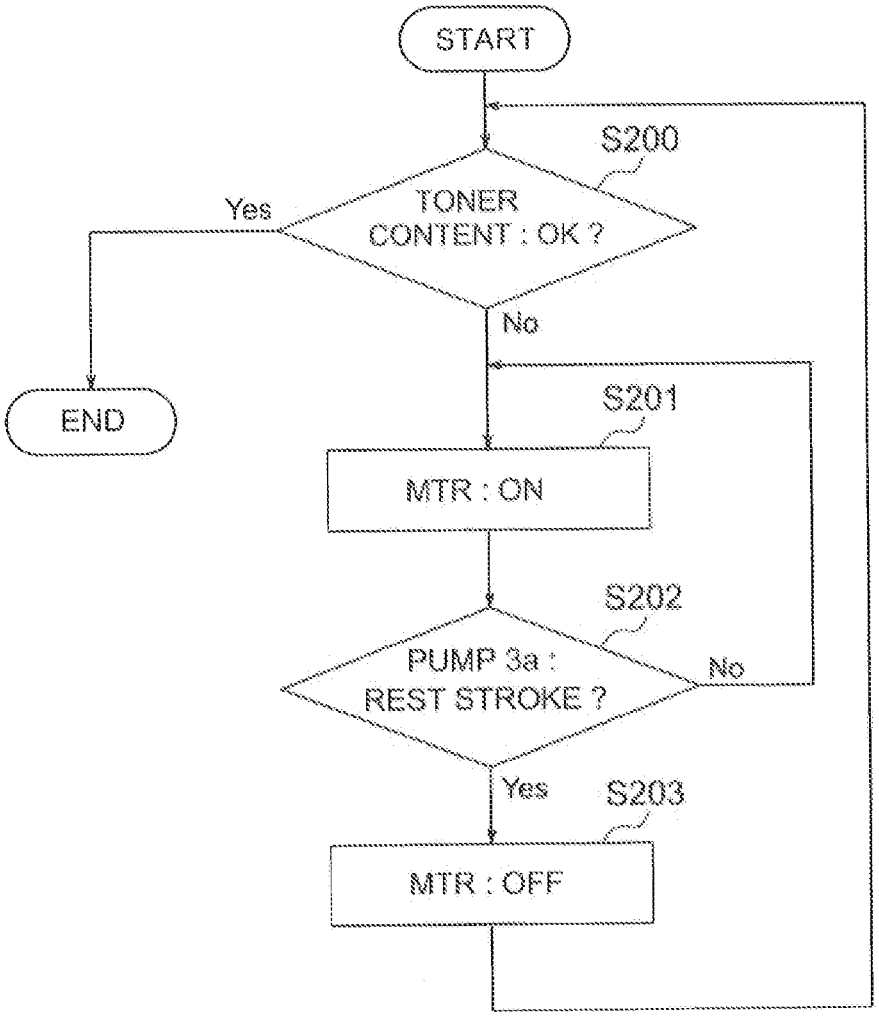

FIG. 13 is a flowchart illustrating a rotation control of the driving motor.

Figure 14:
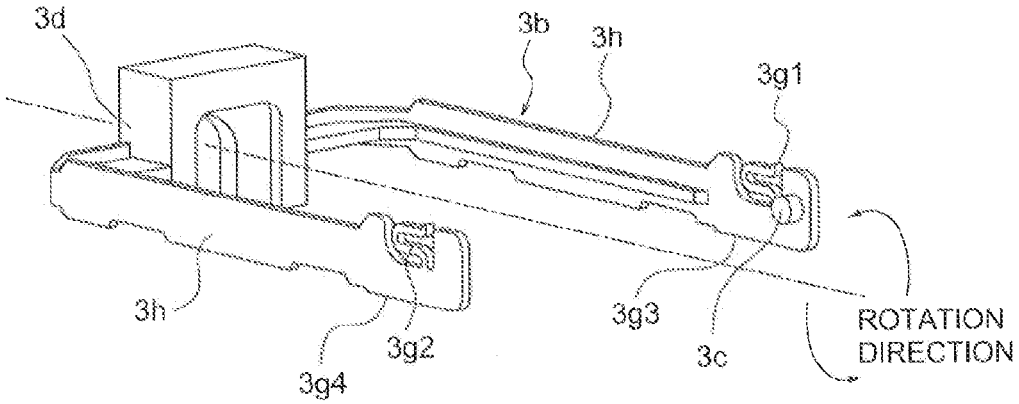
Figure 14:
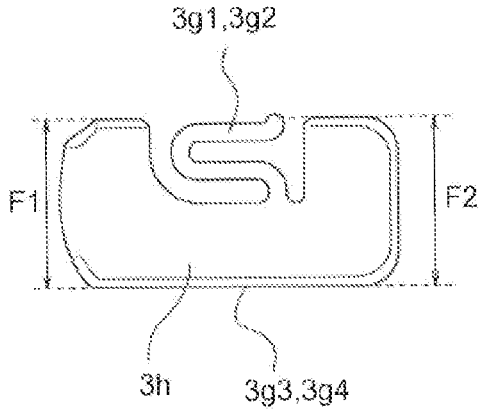

Part (a) of FIG. 14 is a schematic perspective view illustrating a structure of the reciprocating member according to the first embodiment of the present invention used with the developer supplying system comprising the developer supply container, (b) is a partial enlarged view illustrating a structure of an urging portion for the reciprocating member according to the first embodiment.

Figure 15:
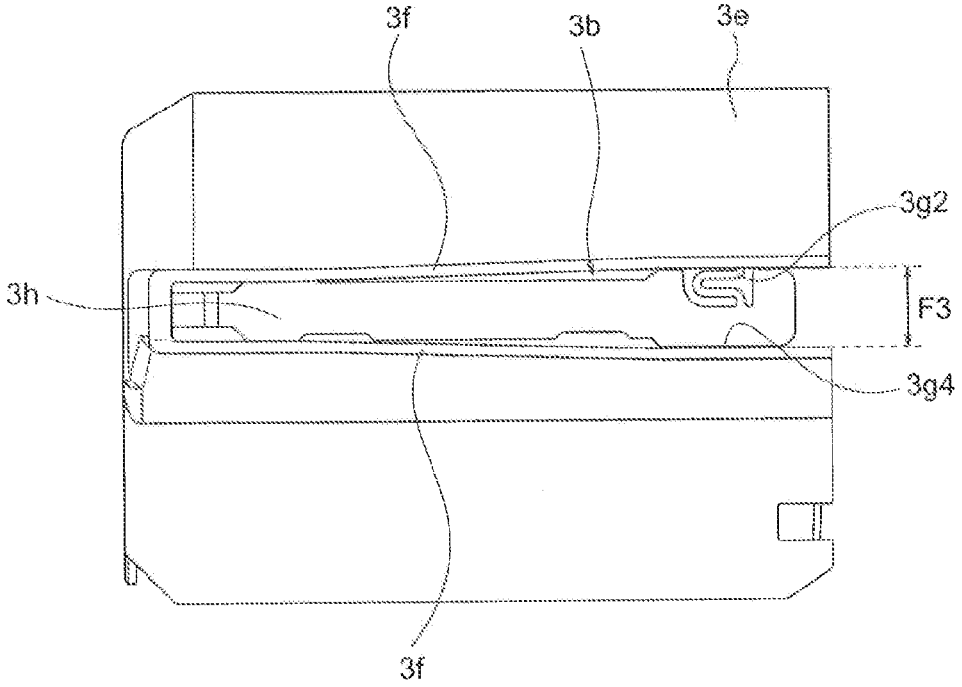

FIG. 15 is a schematic sectional view illustrating the structures of the reciprocating member and the regulating portion according to the first embodiment.

Figure 16:
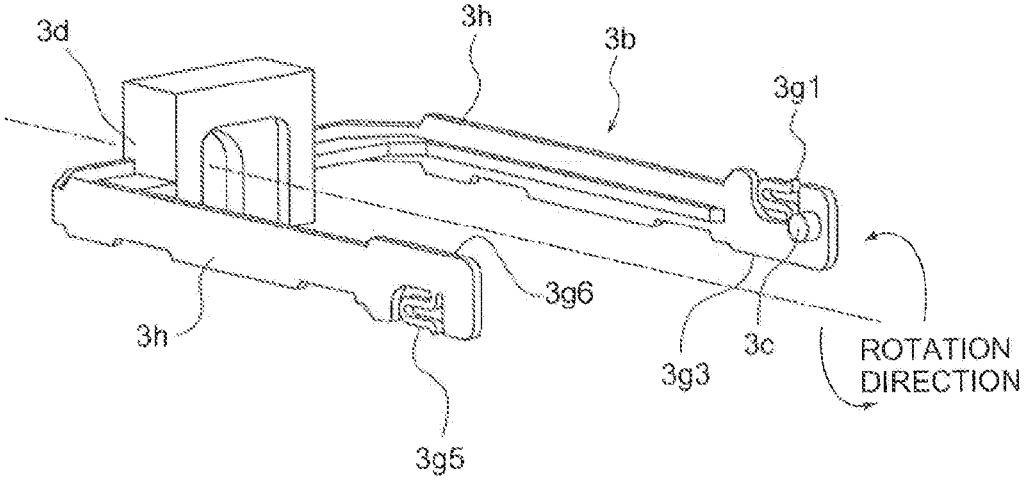

FIG. 16 as a schematic perspective view illustrating a structure of the reciprocating member in which the urging portion is provided in the downstream side with respect to the rotational moving direction in a second embodiment of the developer supplying system comprising the developer supply container, according to the present invention.

DESCRIPTION OF THE EMBODIMENTS

Referring to the accompanying drawings, a developer supplying system comprising the developer supply container according to an embodiment of the present invention will be described in detail. In the following description, various structures of the developer supply container may be replaced with other known structures having similar functions within the scope of the concept of invention unless otherwise stated. In other words, the present invention is not limited to the specific structures of the embodiments which will be described hereinafter, unless otherwise stated.

First, referring to FIGS. 1-15, structures of the developer supplying system comprising the developer supply container according to the first embodiment of the present invention will be described.

An example of an image forming apparatus 100 using the developer supplying system comprising the developer supply container 1 according to the present invention will first be described. Then, the structures of the developer supplying apparatus 201 and the developer supply container 1 constituting the developer supplying system used by the image forming apparatus 100 will be described.

<Image Forming Apparatus>

Figure 1:
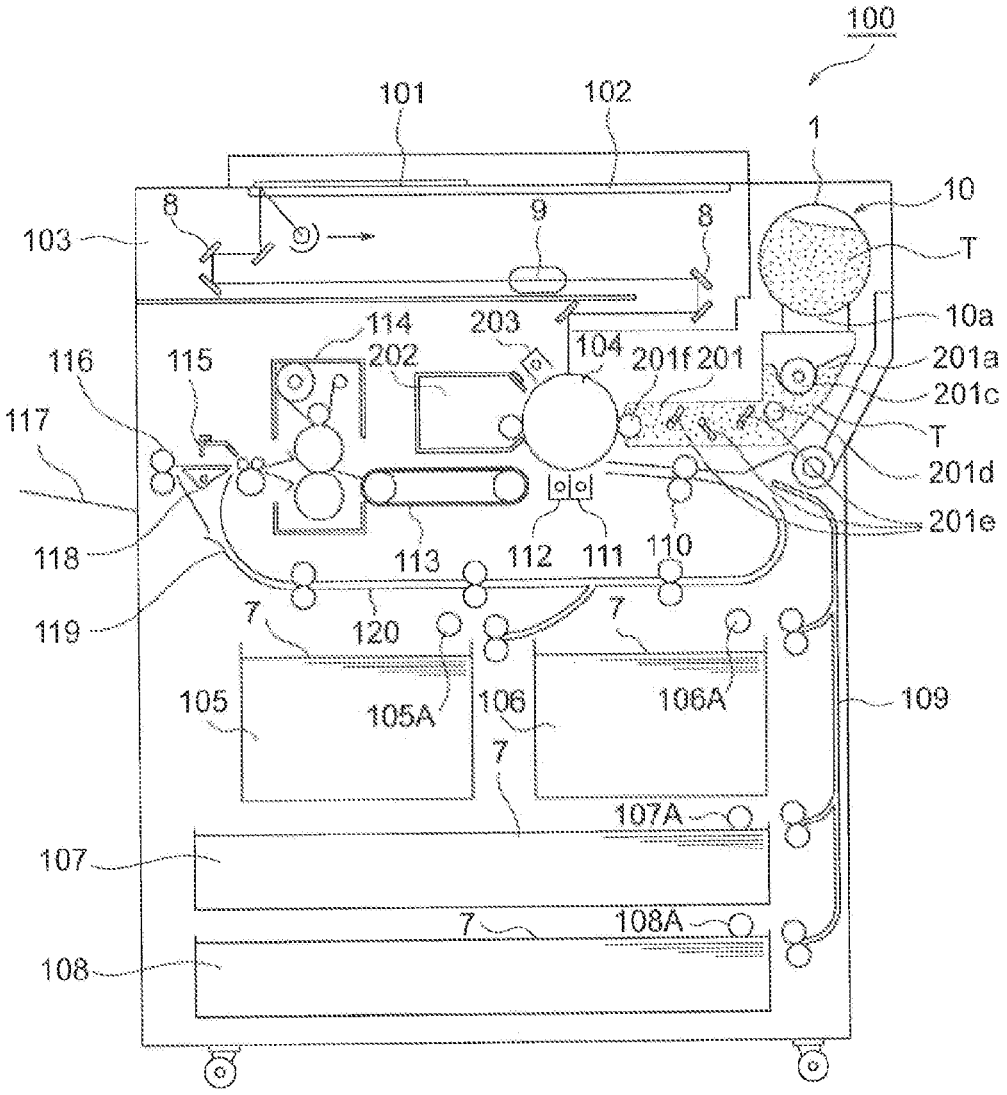
FIG. 1 is a schematic sectional view of a general arrangement of an image forming apparatus using a developer supplying system comprising a developer supply container according to the present invention.

Referring to FIG. 1, the description will be made as to structures of a copying machine (electrophotographic image forming apparatus) employing an electrophotographic type process as an example of an image forming apparatus 100 using a developer replenishing apparatus 201 to which a developer supply container (so-called toner cartridge) is detachably mountable.

In the Figure, designated by 100 is a main assembly of the copying machine (main assembly of the image forming apparatus or main assembly of the apparatus). Designated by 101 is an original which is placed on an original supporting platen glass 102. A light image corresponding to image information of the original 101 is imaged on a surface of an electrophotographic photosensitive member 104 (photosensitive member) by way of a plurality of mirrors 8 of an optical portion 103 and a lens 9, so that an electrostatic latent image is formed. The electrostatic latent image is visualized with toner (one component magnetic toner) as a developer (dry powder) T by a dry type developing device (one component developing device) 201*a*.

In this embodiment, the one component magnetic toner is used as the developer T to be supplied from a developer supply container 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Designated by 105-108 are cassettes accommodating recording materials (sheets) 7. Of the sheet 7 stacked in the cassettes 105-108, an optimum cassette is selected on the basis of sheet size information, the original 101 or information inputted by the operator (user) from a liquid crystal operating portion of the copying machine.

One sheet 7 supplied by a separation and feeding device 105A-108A is fed to registration rollers 110 along a feeding portion 109. And, it is fed by registration rollers 110 at timing synchronized with rotation of a photosensitive member 104 and with scanning of an optical portion 103.

Designated by 111 is a transfer charger, and 112 is a separation charger. An image of the developer (toner image) formed on the surface of the photosensitive member 104 is transferred onto the sheet 7 by a transfer charger 111. Then, the sheet 7 carrying the developed image (toner image) transferred thereonto is separated from the photosensitive member 104 by the separation charger 112.

Thereafter, the sheet 7 fed by the feeding portion 113 is subjected to heat and pressure in a fixing portion 114 so that the developed image on the sheet 7 is fixed, and then passes through a discharging/reversing portion 115, in the case of one-sided copy mode, and subsequently the sheet 7 is discharged to a discharging tray 117 by discharging rollers 116.

In the case of a duplex copy mode, the sheet 7 enters the discharging/reversing portion 115 and a part thereof is ejected once to an outside of the image forming apparatus by the discharging roller 116. The trailing end of the sheet 7 passes through a flapper 118, and a flapper 118 is controlled when it is still nipped by the discharging rollers 116, and the discharging rollers 116 are rotated reversely. By this, the sheet 7 is refed into the apparatus. Then, the sheet 7 is fed to the registration rollers 110 by way of re-feeding portions 119, 120, and then conveyed along the feeding path similarly to the case of the one-sided copy mode and is discharged to the discharging tray 117.

In the main assembly of the image forming apparatus 100, around the photosensitive member 104, there are provided image forming process equipment (process means) such as a developing device 201*a* as the developing means a cleaner portion 202 as a cleaning means, a primary charger 203 as charging means. The developing device 201*a* develops the electrostatic latent image formed on the photosensitive member 104 by the optical portion 103 in accordance with image information of the 101, by depositing the developer (toner) onto the latent image.

The primary charger 203 functions to uniformly charge the surface of the photosensitive member 104 so that an intended electrostatic image is formed on the photosensitive member 104. In addition, the cleanup portion 202 is to remove the developer remaining on the surface of the photosensitive member 104.

(Developer Supplying Apparatus)

Referring to FIGS. 1-4, a structure of a developer replenishing apparatus 201 which is a constituent-element of the developer supplying system will be described. Part (a) of FIG. 2 is a partially sectional view of the developer supplying apparatus. Part (b) is a perspective view of a mounting portion. Part (c) is a sectional view of the mounting portion.

FIG. 3 is partly enlarged sectional views of a structure of a control system, the developer supply container 1 and the developer replenishing apparatus 201. FIG. 4 is a flow chart illustrating a flow of developer supply operation.

As shown in FIG. 1, the developer replenishing apparatus 201 comprises the mounting portion (mounting space) 10, to which the developer supply container 1 is mounted demountably, a hopper 10*a* for storing temporarily the developer discharged from the developer supply container 1, and the developing device 201*a* 999 and the 9. As shown in part (c) of FIG. 2, the developer supply container 1 is mountable in a direction indicated by an arrow M shown in part (c) to the mounting portion 10. Thus, a longitudinal direction (rotational axis direction) of the developer supply container 1 is substantially the same as the direction of arrow M. In addition, a dismounting direction of the developer supply container 1 from the mounting portion 10 is opposite the direction (inserting direction) of the arrow M.

As shown in parts (a) of FIGS. 1 and 2, the developing device 201*a* comprises a developing roller 201*f*, a stirring member 201*c*, and feeding members 201*d* and 201*e*. The developer supplied from the developer supply container 1 is stirred by the stirring member 201*c*, is fed to the developing roller 201*f* by the magnet roller 201*d* and the feeding member 201*e*, and is supplied to the surface of the photosensitive member 104 by the developing roller 201*f*.

A developing blade 201*g* for regulating an amount of developer coating on the roller is provided relative to the developing roller 201*f*. And a leakage preventing sheet 201*h* is provided contacted to the developing roller 201*f* to prevent leakage of the developer between the developing device 201*a* and the developing roller 201*f*.

As shown in part (b) of FIG. 2, the mounting portion 10 is provided with a rotation regulating portion (regulating portion) 11 for limiting movement of the flange portion 4 in the rotational moving direction by abutting to a flange portion 4 shown in FIG. 6 of the developer supply container 1 when the developer supply container 1 is mounted. The rotational regulating portion 11 limits the movement in the direction perpendicular to the reciprocation of the reciprocating member 3*b*.

Furthermore, as shown in part (b) of FIG. 6, there is provided a developer receiving port (developer reception hole) 13 for receiving the developer discharged from the developer supply container 1 shown in part (c) of FIG. 2, and the developer receiving port is brought into fluid communication with a discharge opening (discharging port) 4*a*. The developer is supplied from the discharge opening 4*a* of the developer supply container 1 to the developing device 201*a* through the developer receiving port 13. The discharge opening (discharging port) 4*a* discharging the developer T fed by the feeding portion 2*k* including a cylindrical portion.

In this embodiment, a diameter ϕ of the developer receiving port 13 shown in part (c) of FIG. 2 is approx. 3 mm (pin hole), for the purpose of preventing as much as possible the contamination by the developer T in the mounting portion 10. The diameter ϕ of the developer receiving port 13 may be any if the developer can be discharged through the discharge opening 4*a*.

As shown in FIG. 3, the hopper 10*a* comprises a feeding screw 10*b* for feeding the developer T to the developing device 201*a* an opening 10*c* in fluid communication with the developing device 201*a*. It also comprises a developer sensor 10*d* for detecting an amount of the developer accommodated in the hopper 10*a*.

As shown in parts (b) and (c) of FIG. 2, the mounting portion 10 is provided with a driving gear 300 functioning as a driving mechanism (driver). The driving gear 300 receives a rotational force from a driving motor 500 through a driving gear train, and functions to apply a rotational force to the developer supply container 1 which is set in the mounting portion 10.

As shown in FIG. 3, the driving motor 500 is controlled by a control device (CPU (central processing unit)) 600. As shown in FIG. 3, the control device 600 controls the operation of the driving motor 500 on the basis of information indicative of a developer remainder inputted from the developer sensor 10*d*.

In this embodiment, the driving gear 300 shown in parts (b) and (c) of FIG. 2 is rotatable unidirectionally to simplify the control for the driving motor 500. The control device 600 controls only ON (operation) and OFF (non-operation) of the driving motor 500. This simplifies the driving portion for the developer replenishing apparatus 201 as compared with a structure in which forward and backward driving forces are provided by periodically rotating the driving motor 500 (driving gear 300) in the forward direction and backward direction. The image forming apparatus 100 comprises a detecting portion 600*a* including a photosensor assisting the control device 600 in deactivating the driving motor 500.

(Mounting/Dismounting Method of Developer Supply Container)

The description will be made as to mounting/dismounting method of the developer supply container 1.

First, the operator opens an exchange cover and inserts and mounts the developer supply container 1 to a mounting portion 10 of the developer replenishing apparatus 201. With the mounting operation, the flange portion 4 of the developer supply container 1 is held and fixed in the developer replenishing apparatus 201.

Thereafter, the operator closes the exchange cover to complete the mounting step. Thereafter, the control device 600 controls the driving motor 500, by which the driving gear 300 rotates at proper timing.

On the other hand, when the developer supply container 1 becomes empty, the operator opens the exchange cover and takes the developer supply container 1 out of the mounting portion 10. The operator inserts and mounts a new developer supply container 1 prepared beforehand and closes the exchange cover, by which the exchanging operation from the removal to the remounting of the developer supply container 1 is completed.

(Developer Supply Control by Developer Replenishing Apparatus)

Referring to a flow chart of FIG. 4, a developer supply control by the developer replenishing apparatus 201 will be described. The developer supply control is executed by controlling various equipment by the control device 600.

In this embodiment, the control device 600 controls the operation/non-operation of the driving motor 500 in accordance with an output of the developer sensor 10*d* as shown in FIG. 3 by which the developer T is not accommodated in the hopper 10*a* beyond a predetermined amount.

More particularly, first, the developer sensor 10*d* checks the accommodated developer amount in the hopper 10*a* (step 100). When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (step S101).

The accommodated developer amount detected with developer sensor 10*d* is discrimination ed as having reached the predetermined amount, that is, when the developer is detected by the developer sensor 10*d*, as a result of the developer supplying operation, the driving motor 500 is deactuated to stop the developer supplying operation (step S102). By the stop of the supplying operation, a series of developer supplying steps is completed.

Such developer supplying steps are carried out repeatedly whenever the accommodated developer amount in the hopper 10*a* becomes less than a predetermined amount as a result of consumption of the developer T by the image forming operations.

The structure may be such that the developer discharged from the developer supply container 1 is stored temporarily in the hopper 10*a*, and then is supplied into the developing device 201*a*. More specifically, the following structure of the developer replenishing apparatus 201 can be employed.

As shown in FIG. 5, the above-described hopper 10*a* is omitted, and the developer T is supplied directly into the developing device 201*a* from the developer supply container 1. FIG. 5 shows an example using a two-component developing device 800 as a developer replenishing apparatus 201. The two-component developing device 800 comprises a developer stirring chamber 12 into which the developer T is supplied, and a developer chamber 14 for supplying the developer T to the developing sleeve 800*a*, wherein the developer stirring chamber 12 and the developer chamber 14 are provided with stirring screws 800*b* rotatable in such directions that the developer is fed in the opposite directions from each other.

The developer stirring chamber 12 and the developer chamber 14 are communicated with each other in the opposite longitudinal end portions (with respect to a direction from a back side of the sheet of the drawing of FIG. 5 to the front side thereof), and the two-component developer T are circulated in the two chambers. The developer stirring chamber 12 is provided with a developer sensor (magnetometric sensor) 800*c* for detecting a toner content of the developer, and on the basis of the detection result of the developer sensor 800*c*, the control device 600 controls the operation of the driving motor 500. In such a case, the developer supplied from the developer supply container is non-magnetic toner or non-magnetic toner plus magnetic carrier.

(Developer Supply Container)

Referring to FIGS. 6-8, the structure of the developer supply container 1 which is a constituent-element of the developer supplying system will be described. Part (a) of FIG. 6 is a perspective view illustrating the developer supply container according to Embodiment 1 of the present invention. Part (b) thereof is a partial enlarged view illustrating a portion around a discharge opening. Part (c) thereof is a front view illustrating a state in which the developer supply container 1 is detachably mounted to the mounting portion of the developer supplying apparatus 201. FIG. 7 is a perspective view of a section of the developer supply container 1. Part (a) of FIG. 8 is a partially sectional view in a state in which the pump portion 3*a* is expanded to the maximum usable limit. Part (b) of FIG. 8 is a partially sectional view in a state in which the pump portion 3*a* is contracted to the maximum usable limit.

As shown in part (a) of FIG. 6, the developer supply container 1 includes a developer accommodating portion 2 (container body) having a hollow cylindrical inside space for accommodating the developer T. In this embodiment, a feeding portion 2*c* for feeding the developer T in the developer accommodating portion 2 with rotation, the discharging portion 4*c* shown in FIG. 5 and the pump portion 3*a* function as the developer accommodating portion 2. The feeding portion 2*c* projects to the inside of the developer accommodating portion 2. In this embodiment, by the rotation of the developer accommodating portion 2, the feeding portion 2*c* which is integral with the developer accommodating portion 2 rotates. Here, the longitudinal direction of the developer accommodating portion 2 and the rotational axis direction of the developer accommodating portion (feeding portion) 2 are the same.

The developer supply container 1 is provided with a flange portion 4 (non-rotatable portion) at one end of the developer accommodating portion 2 with respect to the longitudinal direction (developer feeding direction). The feeding portion 2*c* is rotatable relative to the flange portion 4. A cross-sectional configuration of the feeding portion 2*c* may be non-circular as long as the non-circular shape does not adversely affect the rotating operation in the developer supplying step. For example, the cross-sectional configuration may be oval configuration, polygonal configuration or the like.

In this example, as shown in FIG. 8, a total length L1 of the developer accommodating portion 2 is approx. 460 mm, and an outer diameter R1 of the developer accommodating portion 2 is approx. 60 mm. A length L2 of the range in which the discharging portion 4*c* functioning as the developer discharging chamber is approx. 21 mm. A total length L3 of the pump portion 3*b* (in the state that it is most expanded in the expansible range in use) is approx. 29 mm. A total length L4 of the pump portion 3*a* (in the state that it is most contracted in the expansible range in use) is approx. 24 mm.

As shown in FIGS. 6-8, in this embodiment, in the state shown in FIG. 1 that the developer supply container 1 is mounted to the developer replenishing apparatus 201, the developer accommodating portion 2 and the discharging portion 4*c* are substantially on line along a horizontal direction. That is, the developer accommodating portion 2 has a sufficiently long length in the horizontal direction as compared with the length in the vertical direction, and one end part with respect to the horizontal direction is connected with the developer discharging portion 4*c*. For this reason, an amount of the developer T existing above the discharge opening 4*a* which will be described hereinafter can be made smaller as compared with the case in which the cylindrical portion 2*k* is above the discharging portion 4*c* in the state that the developer supply container 1 is mounted to the developer replenishing apparatus 201. Therefore, the developer in the neighborhood of the discharge opening 4*a* is less compressed, thus accomplishing smooth suction and discharging operation by the pump portion 3*a*.

(Material of Developer Supply Container)

In this embodiment, as will be described hereinafter, the developer T is discharged through the discharge opening 4*a* by changing an internal volume of the developer supply container 1 by the pump portion 3*a* shown in FIGS. 7 and 8. Therefore, the material of the developer supply container 1 is preferably such that it provides an enough rigidity to avoid collision or extreme expansion against the volume change.

In addition, in this embodiment, the developer supply container 1 is in fluid communication with an outside only through the discharge opening 4*a*, and is sealed except for the discharge opening 4*a*. Such a hermetical property as is enough to maintain a stabilized discharging performance in the discharging operation of the developer through the discharge opening 4*a* is provided by the decrease and increase of the volume of developer supply container 1 by the pump portion 3*a*.

Under the circumstances, this embodiment employs polystyrene resin material as the materials of the developer accommodating portion 2 and the discharging portion 4*c* and employs polypropylene resin material as the material of the pump portion 3*a*.

As for the material for the developer accommodating portion 2 and the discharging portion 4*c*, other resin materials such as ABS (acrylonitrile, butadiene, styrene copolymer resin material), polyester, polyethylene, polypropylene, for example are usable. Alternatively, they may be metal.

As for the material of the pump portion 3*a*, any material is usable if it is expansible and contractable enough to change the internal pressure of the developer supply container 1 by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump portion 3*a*, developer accommodating portion 2 and the develop an discharging portion 4*c* satisfy the above described conditions, respectively.

In the following, the description will be made as to the flange portion 4, the developer accommodating portion 2, the pump portion 3*a*, and the gear portion 2*d* for receiving a rotational driving force for rotating the feeding portion 2*c* from the developer supplying apparatus 201. In addition, a cam mechanism as a drive converting portion for converting the rotational driving force received by the gear portion 2*d* as the drive receiving portion into a force for movement in the rotational axis direction will be described.

(Flange Portion)

As shown FIGS. 7 and 8, the flange portion 4 is provided with a hollow discharging portion (developer discharging chamber) 4*c* for temporarily accommodating the developer having been fed from the developer accommodating portion 2. A bottom portion of the developer discharging portion 4*c* is provided with the small discharge opening 4*a* for permitting discharge of the developer T to the outside of the developer supply container 1, that is, for supplying the developer T into the developer replenishing apparatus 201.

The flange portion 4 is provided with a shutter 4*b* for opening and closing the discharge opening 4*a*. The shutter 4*b* is provided at a position such that when the developer supply container 1 is mounted to the mounting portion 10, it is abutted to an abutting portion 21 (see part (b) of FIG. 2) provided in the mounting portion 10. Therefore, the shutter 4*b* slides relative to the developer supply container 1 (opposite from the arrow M direction of part (c) of FIG. 2) with the mounting operation of the developer supply container 1 to the mounting portion 10. As a result, the shutter 4*b* retracted from the position covering the discharge opening 4*a* so that the discharge opening 4*a* is exposed, thus completing the unsealing operation.

At this time, as shown in FIG. 3, the discharge opening 4*a* is positionally aligned with the developer receiving port 13 of the mounting portion 10, and therefore, they are brought into fluid communication with each other, thus enabling the developer supply from the developer supply container 1.

The flange portion 4 is constructed such that when the developer supply container 1 is mounted to the mounting portion 10 of the developer replenishing apparatus 201, it is non-rotatable relative to the rotation of the developer accommodating portion 2.

More particularly, a rotation regulating portion 11 shown in part (b) of FIG. 2 is provided so that the flange portion 4 does not rotate in the rotational direction of the gear portion 2*d*.

Therefore, in the state that the developer supply container 1 is mounted to the developer replenishing apparatus 201, the developer discharging portion 4*c* provided in the flange portion 3 is prevented substantially in the rotational moving direction. However, movement within the play is permitted.

On the other hand, the developer accommodating portion 2 is not limited in the rotational moving direction by the developer replenishing apparatus 201, and therefore, is rotatable in the developer supplying step.

(Developer Accommodating Portion (Cylindrical Portion))

Referring to FIGS. 6-8, the developer accommodating portion 2 functioning as the developer accommodating chamber will be described. In this embodiment, the developer accommodating portion 2 has a cylindrical shape (feeding portion 2*k*).

As soon in FIGS. 6-8, an inner surface of the feeding portion 2*k* is provided with a feeding portion 2*c* which is projected and extended helically, the feeding projection 2*c* functioning as a feeding portion for feeding the developer T accommodated in the developer accommodating portion 2 toward the developer discharging portion 4*c* (discharge opening 4*a*) with rotation thereof.

The feeding portion 2*k* is formed by a blow molding method from an above-described resin material.

In order to increase a filling capacity by increasing the volume of the developer supply container 1, it would be considered that the height of the flange portion 4 as the developer accommodating portion 2 is increased to increase the volume thereof. However, with such a structure, the gravitation to the developer T adjacent the discharge opening 4*a* increases due to the increased weight of the developer T. As a result, the developer T adjacent the discharge opening 4*a* tends to be compacted with the result of obstruction to the suction/discharging through the discharge opening 4*a*. In this case, in order to loosen the developer T compacted by the suction through the discharge opening 4*a* or in order to discharge the developer by the discharging, the volume change of the pump portion 3*a* has to be increased. As a result, the driving force for driving the pump portion 3*a* has to be increased, and the load to the main assembly of the image forming apparatus 100 may be increased.

In this embodiment, the axial direction of the feeding portion 2*k* and the axial direction of the flange portion 4 are horizontal. Therefore, the thickness of the developer layer on the discharge opening 4*a* in the developer supply container 1 can be made small. By doing so, the developer does not tend to be compacted by the gravitation. For this reason, the developer T can be discharged stably without large load to the main assembly of the image forming apparatus 100.

As shown in FIG. 8, the feeding portion 2*k* is fixed rotatably relative to the flange portion 4 with a flange seal 5*b* of a ring-like sealing member provided on the inner surface of the flange portion 4 being compressed.

By this, the cylindrical portion 2*k* rotates while sliding relative to the flange seal 5*b*. Therefore, the developer T does not leak out during the rotation and a hermetical property is provided. Thus, the air can be brought in and out through the discharge opening 4*a*, so that desired states of the volume change of the developer supply container 1 during the developer supply can be accomplished.

(Pump Portion)

Referring to FIGS. 7 and 8, the description will be made as to the pump portion (reciprocable pump) 3*a* in which the volume thereof changes with reciprocation in the axial direction of the feeding portion 2*k*.

The pump portion 3*a* of this embodiment is in fluid communication with the inside of the developer supply container 1. The pump portion 3*a* of this embodiment functions as a suction and discharging mechanism for repeating the sucking operation and the discharging operation alternately through the discharge opening 4*a*. In other words, the pump portion 3*a* functions as an air flow generating mechanism for generating repeatedly and alternately air flow into the developer supply container 1 and air flow out of the developer supply container through the discharge opening 4*a*.

As shown in part (a) of FIG. 8, the pump portion 3*a* is provided at a position away from the developer discharging portion 4*c* in a direction X. The pump portion 3*a* of this embodiment does not rotate in the rotational direction of the cylindrical portion 2*k* together with the developer discharging portion 4*c*. The pump portion 3*a* plays an important function for the fluidization of the developer in the suction operation.

In this embodiment, the pump portion 3*a* is a displacement type pump (bellow-like pump) of resin material in which the volume thereof changes with the reciprocation. More particularly, as shown in FIGS. 7 and 3, the bellow-like pump portion 3*a* includes crests and bottoms periodically and alternately at the peripheral portion of the pump portion 3*a*. The pump portion 2*b* repeats the compression and the expansion alternately by the driving force received from the developer replenishing apparatus 201. In this embodiment, the volume change by the expansion and contraction is 5 cm^3 (cc).

Using the pump portion 3*a* of such a structure, the volume of the developer supply container 1 can be alternately changed repeatedly at predetermined intervals. As a result, the developer T in the developer discharging portion 4*c* can be discharged efficiently through the discharge opening 4*a*.

(Drive Receiving Portion)

The description will be made as to a structure of the gear portion 2*d* as in the drive receiving portion for receiving the rotational force for rotating the feeding portion 2*k* from the developer replenishing apparatus 201.

As shown in part (a) of FIG. 6, the developer supply container 1 is provided with a gear portion 2*d* which functions as a drive receiving mechanism engageable with a driving gear 300 (functioning as driving mechanism) of the developer replenishing apparatus 201. The gear portion 2*d* and the feeding portion 2*k* are integrally rotatable.

Therefore, the rotational force inputted to the gear portion 2*d* from the driving gear 300 is transmitted to the pump portion 3*a* through a reciprocation member 3*b* which is reciprocable in the rotation axis direction of the feeding portion 2*k* shown in part (a) and (b) of FIG. 9.

The bellow-like pump portion 3*a* of this embodiment is made of a resin material having a high property against torsion or twisting about the axis within a limit of not adversely affecting the expanding-and-contracting operation.

In this embodiment, the gear portion 2*d* is provided on a peripheral surface at one longitudinal end of the feeding portion 2*k*, but this is not inevitable. For example, the gear portion 2*a* may be provided at the other longitudinal end side of the developer accommodating portion 2 with respect to the longitudinal direction of the developer accommodating portion 2, that is, the trailing end portion of the developer accommodating portion. In such a case, the driving gear 300 is provided at a position corresponding to the gear portion 2*d*.

In this embodiment, a gear mechanism is employed as the driving connection mechanism between the gear portion 2*d* as the drive receiving portion of the developer supply container 1 and the driving gear 300 as the driver of the developer replenishing apparatus 201, but this is not inevitable, and a known coupling mechanism, for example is usable. However, this is not inevitable to the present invention, but a coupling mechanism may be used. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

(Drive Converting Mechanism)

A drive converting mechanism (drive converting portion) for the developer supply container 1 for converting the rotational driving force received by the gear portion 2*d* as the drive receiving portion for the feeding portion 2*k* will be described. In this embodiment, a cam mechanism is taken as an example of the drive converting mechanism.

The developer supply container 1 is provided with the cam mechanism which functions as the drive converting portion for converting the rotational force for rotating the feeding portion 2*k* received by the gear portion 2*d* as the drive receiving portion to a force in the reciprocating directions of the pump portion 3*a*.

In this embodiment, one drive receiving portion (gear portion 2*d*) receives the driving force for rotating the feeding portion 2*k* and for reciprocating the pump portion 3*a*, and the rotational force received by converting the rotational driving force received by the gear portion 2*d* to a reciprocation force in the developer supply container 1 side.

Because of this structure, the structure of the drive receiving mechanism for the developer supply container 1 is simplified as compared with the case of providing the developer supply container 1 with two separate drive receiving portions. In addition, the drive is received by a single driving gear 300 of developer replenishing apparatus 201, and therefore, the drive converting portion of the developer replenishing apparatus 201 is also simplified.

Part (a) of FIG. 9 is a partial view in a state in which the pump portion is expanded to the maximum usable limit. Part (b) of FIG. 9 is a partial view in a state in which the pump portion is contracted to the maximum usable limit. Part (c) of FIG. 9 is a front view of the pump portion 3*a*.

As shown in part (a) of FIG. 9 and part (b) of FIG. 9, the drive converting portion for converting the rotational force received by the gear portion 2*d* to the reciprocation force for the pump portion 3*a* is constituted by the cam mechanism. The cam mechanism is constituted by a cam groove 2*e* formed in an outer peripheral surface of the feeding portion 2*k*1 which is in fluid communication with the feeding portion 2*k*, and the projection 3*c* engaged with the reciprocating member 3*b* and engaged with the cam groove 2*e*. More specifically, the cam groove 2*e* extended on the entire circumference of the outer peripheral surface of the feeding portion 2*k*1 integral with gear portion 2*d* as the driven receiving portion for receiving the rotation from the driving gear 300. As shown in part (a) of FIG. 14, the cam grooves 2*e* are engaged with the projections 3*c* projecting toward an inside at end portions of a pair of arm portions 3*h* of the U-shaped reciprocating member 3*b*. The projection 3*c* of this embodiment is engaged with or fixed to the arm portion 3*h* of the reciprocating member 3*b*.

In this embodiment, as shown in part (c) of FIG. 9, the reciprocating member 3*b* is confined by a rotation regulating portion 3*f* which functions as a regulating portion of the feeding portion 2*k* in the rotational moving direction. By this, as shown in part (a) of FIG. 14, the projections 3*c* provided at the respective end portions of the arm portions 3*h* (pair) of the U-shaped reciprocating member 3*b* are engaged with the cam grooves 2*e* so that the reciprocating member 3*b* reciprocates in the expansion and contracting directions of the pump portion 3*a* along the cam grooves 2*e*.

The number of the projections 3*c* engaged with the reciprocating member 3*b* maybe at least one. If, however, a moment is produced at the drive converting portion including the cam groove 2*e* and the projection 3*c* by the drags in the expansion and contraction of the pump portion 3*a* with the result of the deterioration of the smooth reciprocation, it is preferable to provide a plurality of projections 3*c* along the cam grooves 2*e*.

In this embodiment, two projections 3*c* engaged with the reciprocating member 3*b* are provided along the cam groove 2*e* so as to provide two position engagement. More particularly, the projections 3*c* engaged with the reciprocating member 3*b* are provided at 180° opposed to each other about the rotational axis of the feeding portion 2*k*.

That is, the rotational force supplied from the driving gear 300 is transmitted to the gear portion 2*d*, and the cam groove 2*e* rotates integrally with the gear portion 2*d*. By this, the projections 3*c* engaged with the reciprocating member 3*b* reciprocate in the arrow M direction and the opposite direction. In addition, the reciprocating member 3*b* integral with the projections 3*c* reciprocates in the rotational axis direction of the feeding portion 2*k*. By this, the pump portion 3*a* repeats alternately the expanded state shown in part (a) of FIG. 8 and the contracted the state shown in part (b) of FIG. 8. By this, the volume of the developer supply container 1 can be changed.

<Set Condition of Drive Converting Portion>

In this embodiment, the feeding amount of the developer T per unit time to the developer discharging portion 4*c* by the rotation of the feeding portion 2*k* is set as follows. It is made larger by the structure of the drive converting portion including the cam groove 2*e* and the projections 3*c* than the developer discharging amount per unit time into the developer supplying apparatus 201 from the developer discharging portion 4*c* by the operation of the pump portion 3*a*.

If the developer discharging power by the pump portion 3*a* is larger than the developer feeding power into the developer discharging portion 4*c* by the feeding portion 2*c* of the feeding portion 2*k*, the amount of the developer T in the developer discharging portion 4*c* gradually decreases. This will result in longer time required for the developer supply from the developer supply container 1 into the developer supplying apparatus 201. In this embodiment, this can be prevented by the above-described structure.

In addition, in this embodiment, the drive converting portion including the cam groove 2*e* and the projections 3*c* is constituted such that the pump portion 3*a* reciprocates a plurality of times for one rotation of the feeding portion 2*k*.

In the case of the structure in which the feeding portion 2*k* is rotated within the developer supplying apparatus 201, the driving motor 500 preferably has an output power necessary for stably and always rotating the normally.

The necessary output power of the driving motor 500 is calculated on the basis of a rotational torque and a rotational frequency of the feeding portion 2*k*. Therefore, in order to reduce the necessary output power of the driving motor 500, the rotational frequency of the feeding portion 2*k* is preferably as small as possible.

In the case of this embodiment, if the rotational frequency of the feeding portion 2*k* in order to reduce the load to the driving motor 500, the number of reciprocations of the pump portion 3*a* per unit time decreases. This results in the reduction of the amount of the developer T discharged from the developer supply container 1 per unit time. That is, in order to quickly meet the developer supply amount required by the main assembly of the image forming apparatus 100, the amount of the developer T discharged from the developer supply container 1 may not be sufficient in some cases.

If the volume change amount of the pump portion 3*a* is increased, the developer discharge amount per one cycle of the pump portion 3*a* can be increased. By doing so, the developer supply amount required by the main assembly of the image forming apparatus 100 can be met. However, a problem arises in such a case.

When the volume change amount of the pump portion 3*a* is increased, a peak value of the internal pressure (positive pressure) of the developer supply container 1 in the discharging step increases. Then, the load required for the reciprocation of the pump portion 3*a* increases.

For this reason, in this embodiment, the pump portion 3*a* reciprocates a plurality of times four one rotation of the feeding portion 2*k*. By this, the developer discharge amount per unit time can be increased without increasing the volume change amount of the pump portion 3*a*, as compared with the case in which the pump portion 3*a* operates only one cycle for one rotation of the feeding portion 2*k*. Corresponding to the increase of the developer discharge amount, the rotational frequency of the feeding portion 2*k* can be reduced.

<Locating Position of Drive Converting Portion>

As shown in FIG. 9, in this embodiment, the drive converting portion including the cam groove 2*e* and the projection 3*c* is provided on the outer periphery portion of the developer accommodating portion 2. That is, in other to avoid contact of the drive converting portion with the developer accommodated inside the pump portion 3*a* and the flange portion 4, the drive converting portion is provided at a position away from the inside spaces of the feeding portion 2*k*, the pump portion 3*a* and the flange portion 4, namely the outside of the developer supply container 1.

By doing so, the developer T does not easily enter the sliding position between the cam groove 2*e* and the projection 3*c* engaged with the reciprocating member 3*b*, constituting the drive converting portion, so that the possibility of malfunction of the drive converting portion can be reduced.

<Set Condition of Cam Groove>

Referring to FIG. 10, set conditions of the cam groove 2*e* will be described. FIG. 10 is a development of the cam groove 2*e* provided on the outer peripheral surface of the feeding portion 2*k*1. In FIG. 10, an arrow A indicates the rotational direction (moving direction of the cam groove 2*e*) of the feeding portion 2*k*. An arrow B direction in FIG. 10 indicates the expanding direction of the pump portion 3*a*. An arrow C of FIG. 10 indicates the contracting direction of the pump portion 3*a*.

The cam groove 2*e* includes a cam groove 2*g* used when the pump portion 3*a* is contracted, a cam groove 2*h* use when the pump portion 3*a* it expanded, and a cam groove 2*i* constituting a non-operation portion in which the pump portion 3*a* does not operate.

An amplitude of the cam groove 2*e* which is an expansion and contraction length of the pump portion 3*a* in the arrows B and C directions in FIG. 10 which is the expansion and contracting direction of the pump portion 3*a*. It is L3-L4, where L3 is the total length in the most expanded state of the pump portion 3*a* shown in part (a) of FIG. 8, and L4 is the total length in the most contracted state to the pump portion 3*a* shown in part (b) of FIG. 8.

When the cam groove 2*e* rotates in the direction of the arrow A of FIG. 10 with the rotation of the gear portion 2*d*, the projections 3*c* engaged with the reciprocating member 3*b* shown in part (a) of FIG. 14 moves along the cam groove 2*i*, the cam groove 2*h*, the cam groove 2*i* and the cam groove 2*g* shown in FIG. 10 in the order named. In interrelation with the projections 3*c* engaged with the reciprocating member 3*b*, the reciprocating member 3*b* is moved in the direction of the arrow B of FIG. 10 by the cam groove 2*h*, and is moved in the direction of the arrow C of FIG. 10 by the cam groove 2*g*.

<Developer Supplying Step>

Referring to FIGS. 9 and 10, the developer supplying step by the pump portion 3*a* will be described. The developer supplying step using the cam groove 2*g*, the cam groove 2*h* and the cam groove 2*i* shown in FIG. 10 will be described.

In this embodiment, the operation includes a suction stroke in which the air is taken in through the discharging port 4*a* shown in FIG. 3 by the reciprocation of the pump portion 3*a*, a discharging stroke in which the air is discharged through the discharging port 4*a*, and a rest stroke in which the suction or discharging is effected through the discharging port 4*a* because of the non-pumping action of the pump portion 3*a*. The rotational force supplied to the gear portion 2*d* by the drive converting portion including the cam groove 2*e* and the projections 3*c* is converted into a reciprocation force for the pump portion 3*a*.

The rest stroke in which the suction or discharging through the discharging port 4*a* is carried out may be omitted, if only the discharging of the developer T is intended. That is, only the suction stroke and the discharging the drum may be provided. In such a case, an instructing portion 6 instructs using the control device 600 to stop the rotation of the driving motor 500 in the suction stroke or the discharging stroke.

The description will be made as to the suction stroke, the discharging the stroke and the rest stroke.

(Suction Stroke)

First, the suction step including the suction operation through discharge opening 4*a* will be described.

The suction operation is effected by the pump portion 3*a* being changed from the most contracted state (part (b) of FIG. 9) to the most expanded state (part (a) of FIG. 9) by the above-described drive converting portion (cam mechanism) including a cam groove 2*e* and the projection 3*c*. More particularly, by the suction operation, a volume of a portion of the developer supply container 1 (pump portion 3*a*, feeding portion 2*k* and a flange portion 4) which can accommodate the developer increases.

At this time, the developer supply container 1 is substantially hermetically sealed except for the discharge opening 4*a*, and the discharge opening 3*a* is plugged substantially by the developer T. Therefore, the internal pressure of the developer supply container 1 decreases with the increase of the volume of the portion of the developer supply container 1 capable of containing the developer T.

At this time, the internal pressure of the developer supply container 1 is lower than the ambient pressure (external air pressure). For this reason, the air outside the developer supply container 1 enters the developer supply container 1 through the discharge opening 4*a* by a pressure difference between the inside and the outside of the developer supply container 1.

At this time, the air is taken-in from the outside of the developer supply container 1, and therefore, the developer T in the neighborhood of the discharge opening 4*a* can be loosened (fluidized). More particularly, the air impregnated into the developer powder existing in the neighborhood of the discharge opening 4*a*, thus reducing the bulk density of the developer powder T and fluidizing.

Since the air is taken into the developer supply container 1 through the discharge opening 4*a*, the internal pressure of the developer supply container 1 changes in the neighborhood of the ambient pressure (external air pressure) despite the increase of the volume of the developer supply container 1.

In this manner, by the fluidization of the developer T, the developer T does not pack or clog in the discharge opening 4*a*, so that the developer can be smoothly discharged through the discharge opening 4*a* in the discharging operation which will be described hereinafter. Therefore, the amount of the developer T (per unit time) discharged through the discharge opening 4*a* can be maintained substantially at a constant level for a long term.

The occurrence of the air suction is not limited to that by the pump portion 3*a* changing from the most contracted state shown in FIG. 9 (*b*) to the most expanded state shown in FIG. 9 (*a*). However, the air suction is effected if there the internal pressure of the developer supply container 1 changes even if the pump portion stops halfway from the most contracted state to the most expanded state shown in FIG. 9 (*b*). That is, the suction stroke corresponds to the state in which the projection 3*c* engaging with the reciprocation member is engaged with the cam groove (second operation portion) 2*h* shown in FIG. 10.

(Discharging Stroke)

The discharging step including a discharging operation through the discharge opening 4*a* will be described.

The discharging operation is effected by the pump portion 3*a* being changed from the most expanded state shown in FIG. 9 (*a*) to the most contracted state shown in FIG. 9 (*b*). More particularly, by the discharging operation, a volume of a portion of the developer supply container 1 (pump portion 3*a*, feeding portion 2*k* and a flange portion 4*c*) which can accommodate the developer decreases. At this time, the developer supply container 1 is substantially hermetically sealed except for the discharge opening 4*a*, and the discharge opening 4*a* is plugged substantially by the developer T until the developer is discharged. Therefore, the internal pressure of the developer supply container 1 rises with the decrease of the volume of the portion of the developer supply container 1 capable of containing the developer T.

The internal pressure of the developer supply container 1 is higher than the ambient pressure (the external air pressure). Therefore, the developer T is pushed out by the pressure difference between the inside and the outside of the developer supply container 1. That is, the developer T is discharged from the developer supply container 1 into the developer replenishing apparatus 201.

Also air in the developer supply container 1 is also discharged with the developer T, and therefore, the internal pressure of the developer supply container 1 decreases.

As described in the foregoing, according to this embodiment, the discharging of the developer can be effected efficiently using one reciprocation type pump portion 3*a*, and therefore, the mechanism for the developer discharging can be simplified.

The current as of the air discharging is not limited to that by the pump portion 3*a* changing from the most expanded state shown in FIG. 9 (*a*) to the most contracted state shown in FIG. 9 (*b*). However, the air discharging occurs if the internal pressure of the developer supply container 1 changes even if the pump portion changes halfway from the most expanded state shown in FIG. 9 (*a*) to the most contracted state shown in FIG. 9 (*b*). That is, the discharging stroke corresponds to the state in which the engaging projection 3*c* engaging with the reciprocation member 3*b* is engaged with the cam groove 2*g* shown in FIG. 12.

(Rest Stroke)

The rest stroke in which the pump portion 3*a* does not to reciprocate will be described. With this structure in which the developer T is supplied directly into the developing device 201*a* from the developer supply container 1 without using a hopper 10*a*, the amount of the developer T discharged from the developer supply container 1 directly influences on the toner content. Therefore, it is necessary to supply an amount of the developer T required by the image forming apparatus 100 from the developer supply container 1. Therefore, with this structure, the pump portion 3*a* effects the volume change which is constant, from the standpoint of standardizing the amount of the developer T discharged from the developer supply container 1.

When the cam groove 2*e* includes only groove for the discharging stroke and the suction stroke, it is required that the driving motor 500 is stopped halfway in the discharging stroke or suction stroke. At this time, the feeding portion 2*k* continues to rotate by the inertia after the stop of the driving motor 500, and the projections 3*c* of the reciprocating member 3*b* an engaging with the cam grooves 2*e* continue to move, and therefore, the pump portion 3*a* continues to reciprocate. By this, even after the start of the driving motor 500, the discharging stroke or the suction stroke is carried out by the inertia.

The distance through which the feeding portion 2*k* rotates by the inertia is dependent on the rotational speed of the feeding portion 2*k*. In addition, the rotational speed of the feeding portion 2*k* is dependent on the torque applied to the driving motor 500. From this analysis, depending on the amount of the developer T in the developer supply container 1, the torque applied to the driving motor 500 changes, and the rotational speed of the feeding portion 2*k* also changes. Therefore, it is difficult to stop the pump portion 3*a* at a constant stop position.

In other to stop the pump portion 3*a* always at a constant position, it is necessary that the cam groove 2*e* includes the cam groove 2*i* which is a portion not reciprocating the pump portion 3*a* even when the feeding portion 2*k* is rotating. In this embodiment, in order to prevent the reciprocation of the pump portion 3*a*, a cam groove 2*i* extending in the direction parallel with the arrow A direction which is a rotational moving direction of the feeding portion 2*k* (moving direction of the cam groove 2*e*), as shown in FIG. 10.

The cam groove 2*i* extends straight by a predetermined distance in parallel with the arrow A direction which is the rotational direction of the feeding portion 2*k*, and as long as the projections 3*c* engaged with the reciprocating member 3*b* are engaged with the cam grooves 2*i*, the reciprocating member 3*b* is stationary despite the rotation of the feeding portion 2*k*. That is, the rest stroke is the stroke in which the projections 3*c* engaged with the reciprocating member 3*b* are engaged with the cam grooves 2*i*.

In the state in which the pump portion 3*a* does not reciprocate, the developer T is not discharged through the discharging port 4*a*. However, the developer T may spontaneously fall from the discharging port 4*a* due to the vibration or the like caused by the rotation of the feeding portion 2*k*.

The cam groove 2*i* may be inclined relative to the rotational moving direction of the feeding portion 2*k* with respect to the rotational axis direction of the feeding portion 2*k*, if the discharging stroke or suction stroke through the discharging port 4*a* does not work. The reciprocation of the pump portion 3*a* corresponding to the inclination of the cam groove 2*i* is to be permitted.

In this embodiment, the instructing portion 6 is provided to effects control such that the driving motor 500 it is stopped, the projections 3*c* engaged with the reciprocating member 3*b* are engaged with the cam grooves 2*i*.

(Change of Internal Pressure of Developer Supply Container)

Verification experiments were carried out as to a change of the internal pressure of the developer supply container 1. The verification experiments will be described.

The developer is filled such that the developer T accommodating space in the developer supply container 1 is filled with the developer T; and the change of the internal pressure of the developer supply container 1 is measured when the pump portion 3*a* is expanded and contracted in a range of 5 cm3 of volume change. The internal pressure of the developer supply container 1 is measured using a pressure gauge (AP-C40 available from Kabushiki Kaisha KEYENCE) connected with the developer supply container 1.

FIG. 11 shows a pressure change when the pump portion 3*a* is expanded and contracted in the state that the shutter 4*b* shown in FIG. 6 (*b*) of the developer supply container 1 filled with the developer is open, and therefore, in the communicatable state with the outside air.

In FIG. 11, the abscissa represents the time, and the ordinate represents a relative pressure in the developer supply container 1 relative to the ambient pressure (reference (1 kPa) (+ is a positive pressure side, and – is a negative pressure side).

When the internal pressure of the developer supply container 1 becomes negative relative to the outside ambient pressure by the increase of the volume of the developer supply container 1, the outside air is taken in through the discharge opening 4*a* by the pressure difference. When the internal pressure of the developer supply container 1 becomes positive relative to the outside ambient pressure by the decrease of the volume of the developer supply container 1, a pressure is imparted to the inside developer T. At this time, the inside pressure eases corresponding to the discharged developer and air.

By the verification experiments, it has been confirmed that by the increase of the volume of the developer supply container 1, the internal pressure of the developer supply container 1 becomes negative relative to the outside ambient pressure, and the outside air is taken in by the pressure difference through the discharge opening 4*a*. In addition, it has been confirmed that by the decrease of the volume of the developer supply container 1, the internal pressure of the developer supply container 1 becomes positive relative to the outside ambient pressure, and the pressure is imparted to the inside developer so that the developer T is discharged to the outside. In the verification experiments, an absolute value of the negative pressure is approx. 1.2 kPa, and an absolute value of the positive pressure is approx. 0.5 kPa. As described in the foregoing, with the structure of the developer supply container 1 of this example, the internal pressure of the developer supply container 1 switches between the negative pressure and the positive pressure alternately by the suction operation and the discharging operation of the pump portion 3*a*, and the discharging of the developer is carried out properly through the discharge opening 4*a*.

As described in the foregoing, in this embodiment, a simple structure pump portion 3*a* capable of effecting the suction operation and the discharging operation of the developer supply container 1 is provided, by which the discharging of the developer T by the air can be carries out stably while providing the developer loosening effect by the air.

In addition, in this embodiment, the inside of the displacement type pump portion 3*a* is utilized as a developer accommodating space, and therefore, when the internal pressure is reduced by increasing the volume of the pump portion 3*a*, a additional developer accommodating space can be formed. Therefore, even when the inside of the pump portion 3*a* is filled with the developer, the bulk density can be decreased by fluidizing by impregnating the air in the developer powder. Therefore, the developer can be filled in the developer supply container 1 with a higher density than in the conventional art.

In this embodiment, the driving force for rotating the feeding portion 2*k* including the feeding portion 2*c* and the driving force for reciprocating the pump portion 3*a* are received by the single drive receiving portion, that is, the gear portion 2*d*. Therefore, the structure of the drive receiving portion of the developer supply container 1 can be simplified. In addition, the driving force is applied to the developer supply container 1 by the driving gear 300 which is a single driving portion provided in the developer supplying apparatus 201, and therefore, the driving portion of the developer supplying apparatus 201 can be simplified.

According to this embodiment, the rotational force for rotating the feeding portion 2*k* received from the developer supplying apparatus 201 is set as follows. The drive conversion is effected by the drive converting portion including the cam groove 2*e* of the developer supply container 1 and the projection 3*c* engaged with the reciprocating member 3*b*. By doing so, the pump portion 3*a* can be properly reciprocated.

<Instructing Portion>

Referring to FIG. 12, a structure of the instructing portion 6 for instructing the rotation and the drive stop of the developer supplying apparatus 201 will be described. The driving motor 500 is controlled by the control device 600 including the CPU. The instructing portion 6 instructs the control device 600 as to the timing of the rotation drive stop.

FIG. 13 is a flowchart illustrating a rotation control of the driving motor. Referring to FIG. 13, the developer supplying step will be described. As shown in FIGS. 3 and 5, the control device 600 controls the rotating operation of the driving motor 500, depending on the output of the developer sensor 10*d*, 800*c* for detecting the toner content in the developer in the developer stirring chamber 12.

Specifically, the developer sensor 10*d*, 800*c* shown in FIGS. 3 and 5 checks the toner content in the developer T in the developer stirring chamber 12 (step S200). When the toner content of the developer T in the developer stirring chamber 12 is low, the instructing portion instructs the control device 600 to rotate the driving motor 500 (step S201). Then, the gear portion 2*d* starts to rotate by the rotation of the driving motor 500.

In step S202, if the projections 3*c* engaged with the reciprocating member 3*b* are engaged with the cam grooves 2*i* shown in FIG. 10 (rest stroke of the pump portion 3*a*), the operation proceeds to a step S203, where the instructing portion 6 instructs the control device 600 to stop the driving motor 500. That is, the rotation of the gear portion 2*d* is stopped by the rotation drive stop of the driving motor 500.

In the step S202, if the pump portion 3*a* is not in the rest stroke, the operation returns to the step S201 where the driving motor 500 continues to rotate. After repeating this series of operations of the steps S200-S203, the developer sensor 10*d*, 800*c* shown in FIGS. 3 and 5 detects again the toner content of the developer T in the developer stirring chamber 12 (step S200).

When the toner content of the developer T in the developer stirring chamber 12 is sufficient as a result of detection at the step S200, the series of the developer supplying strokes is completed. If, in the step S200, the toner content of the developer T in the developer stirring chamber 12 is not sufficient, the operations of the steps S200-S203 are repeated again.

Referring to FIG. 12, the description will be made as to the states of the instructing portion 6 during the rotation and the rest of the driving motor 500. Part (a) of FIG. 12 is a partial schematic sectional view illustrating structures of the developer supply container 1 and the developer supplying apparatus 201. Part (b) of FIG. 12 is a partial enlarged view illustrating a state that of the instructing portion 6 during the rotation of the driving motor 500. Part (c) of FIG. 12 is a partial enlarged view illustrating a state of the instructing portion 6 in the rest period of the driving motor 500.

In this embodiment, the detecting portion 600*a* is an optical photosensor, and when the optical path of the detecting portion 600*a* is blocked by the light blocking portion 600*b*, the rotation of the driving motor 500 is stopped. When the optical path of the detecting portion 600*a* is not blocked by the light blocking portion 600*b*, the driving motor 500 continues to rotate.

In the state of part (b) of FIG. 12, the instructing portion 6 projecting from a part of the outer peripheral surface of the feeding portion 2*k*1 raises the light blocking portion 600*b* to block the optical path of the detecting portion 600*a*, in the rest period of the pump portion 3*a*.

In the state of part (c) of FIG. 12, the pump portion 3*a* in the discharging stroke or suction stroke, not the rest stroke. The instructing portion 6 is provided at the position away from the light blocking portion 600*b*, and therefore, does not raise the light blocking portion 600*b*, so that the optical path of the detecting portion 600*a* is not blocked by the light blocking portion 600*b*. That is, by the instructing portion 6 raising the light blocking portion 600*b* to block the optical path of the detecting portion 600*a*, the instructing portion 6 instructs the control device 600 to stop the rotation of the driving motor 500.

In this embodiment, each time when the pump portion 3*a* is in the rest stroke, the rotation of driving motor 500 is stopped. By this, the pump portion 3*a* carries out a predetermined volume change at all times. This embodiment is not inevitable to the present invention, but the rotation drive stop is carried out in the suction stroke and/or discharging stroke. In such a case, the instructing portion 6 is provided so as to effect the stop in each stroke.

<Reciprocating Member>

Referring to FIGS. 14 and 15, a structure of the reciprocating member 3*b* for reciprocating the pump portion 3*a* will be described. Part (a) of FIG. 14 is a schematic perspective view illustrating the structure of the reciprocating member 3*b*. Part (b) of FIG. 14 is a partial enlarged view illustrating the structure of elastically deformable urging portions 3*g*1, 3*g*2 provided on the opposite end portions of the U-shaped reciprocating member 3*b*. FIG. 15 is a partially sectional view illustrating a structure of the reciprocating member 3*b* and the rotation regulating portion 3*f* as the regulating portion.

As shown in part (a) of FIG. 14, the reciprocating member 3*b* comprises the projection 3*c*, a pump engaging portion 3*d*, the arm portion 3*h* and the urging portions 3*g*1 and 3*g*2. The urging portions 3*g*1 and 3*g*2 are provided at one side of the reciprocating member 3*b*. On the other side of the reciprocating member 3*b*, there are provided contact portions 3*g*3 and 3*g*4 contacting the rotation regulating portion 3*f*.

The cam groove 2*e* provided on the outer peripheral surface of the feeding portion 2*k*1 is slidably engaged with the projections 3*c* formed on the reciprocating member 3*b*. The pump engaging portion 3*d* is engaged with the pump portion 3*a* and transmits the reciprocation in the rotational axial direction of the feeding portion 2*k* to the pump portion 3*a*. The arm portions 3*h* of the reciprocating member 3*b* connects the projections 3*c* and the pump engaging portion 3*d* in the rotation axial direction of the feeding portion 2*k*.

The rotation regulating portion 3*f* is formed in the rotational axial direction (expansion and contracting direction of the pump portion 3*a*) of the feeding portion 2*k*, and covers the arm portion 3*h* of the reciprocating member 3*b*, except of a part (part (c) of FIG. 9). The arm portions 3*h* of the reciprocating member 3*b* slide in the rotational axial direction inside the rotation regulating portion 3*f* to carry out the reciprocation.

In this embodiment, the rotation regulating portions 3*f* are disposed in the both sides of the reciprocating member 3*b* with respect to the direction perpendicular to the rotational axis direction. The rotation regulating portion 3*f* also functions as a guide portion for guiding the movement of the reciprocating member 3*b*. Between the arm portion 3*h* of the reciprocating member 3*b* and the rotation regulating portion 3*f*, there is a play (gap), and a width F1 of the arm portion 3*h* of the reciprocating member 3*b* shown in part (b) of FIG. 14 and a width F3 of the rotation regulating portion 3*f* shown in FIG. 15 satisfy F1<F3. The width F1 shown in part (b) of FIG. 14 is a width of the arm portion 3*h* of the reciprocating member 3*b*, and the width F3 shown in FIG. 15 is a width of the rotation regulating portion 3*f* shown in part (c) of FIG. 9 as the regulating portion for limiting the movement of the reciprocating member 3*b* only to the reciprocation in the rotational axial direction of the feeding portion 2*k*.

The width F1 of the arm portion 3*h* of the reciprocating member 3*b* shown in part (b) of FIG. 14 and the width F3 of the rotation regulating portion 3*f* shown in FIG. 15 satisfy F1≤F3. Then, the arm portion 3*h* of the reciprocating member 3*b* is locked by the rotation regulating portion 3*f* so that the reciprocating member 3*b* cannot reciprocate in the rotational axial direction (left-right direction in FIG. 15).

Therefore, the width F1 of the arm portion 3*h* of the reciprocating member 3*b* shown in part (b) of FIG. 14 and the width F3 of the rotation regulating portion 3*f* shown in FIG. 15 is required to satisfy F1<F3. In addition, it is preferable that a predetermined gap is provided between the arm portion 3*h* of the reciprocating member 3*b* and the rotation regulating portion 3*f* so that the reciprocating member 3*b* can easily reciprocate in the rotational axial direction (left-right direction of FIG. 15).

<Urging Portion>

In this embodiment, the developer supply container 1 is provided with the reciprocating member 3*b* which reciprocates in the rotational axial direction of the feeding portion 2*k* (arrow M direction of FIGS. 7 and 8, or the direction opposite the arrow M direction), and the reciprocating member 3*b* is provided with the urging portions 3*g*1 and 3*g*2 having an elasticity.

In this embodiment, the elastic urging portion 3*g*1, 3*g*2 wedges in the play between the arm portion 3*h* of the reciprocating member 3*b* and the rotation regulating portion 3*f*. That is, a width F2 including the arm portion 3*h* of the reciprocating member 3*b* shown in part (b) of FIG. 14 and the U-shaped urging portion 3*g*1, 3*g*2, and the width F1 of the arm portion 3*h* of the reciprocating member 3*b* satisfy F1<F2. In addition, the width F2 including the arm portion 3*h* of the reciprocating member 3*b* shown in part (b) of FIG. 14 and the U-shaped urging portion 3*g*1, 3*g*2, and the width F3 of the rotation regulating portion 3*f* shown in FIG. 15 satisfy F2>F3. Here, the width F2 is the dimension when no force is applied to the urging portion 3*g*1, 3*g*2.

In other words, in order to reduction the contact noise between the arm portion 3*h* of the reciprocating member 3*b* and the rotation regulating portion 3*f*, the elastic urging portion 3*g*1, 3*g*2 and the rotation regulating portion 3*f* are always in contact.

In this embodiment, the width F1 of the arm portion 3*h* of the reciprocating member 3*b* is approx. 8.9 mm. The width F2 including the arm portion 3*h* of the reciprocating member 3*b* and the urging portion 3*g*1, 3*g*2 is approx. 9.2 mm. The width F3 of the rotation regulating portion 3*f* is approx. 9.0 mm.

By the urging force of the urging portion 3*g*1, 3*g*2, the contact portion 3*g*3, 3*g*4 contacting the rotation regulating portion 3*f* continues to slide on the rotation regulating portion 3*f*. The contact portion 3*g*3, 3*g*4 is a part of the arm portion 3*h* of the reciprocating member 3*b*. In the direction perpendicular to the rotational axis direction of the cylindrical feeding portion 2*k* (widthwise direction of the reciprocating member 3*b*), the contact portion 3*g*3, 3*g*4 of the reciprocating member 3*b* where the urging portion 3*g*1, 3*g*2 is not provided stably slides on the rotation regulating portion 3*f*. With this structure, even when the rotational force is inputted to the arm portion 3*h* of the reciprocating member 3*b*, no gap is produced between the arm portion 3*h* of the reciprocating member 3*b* and the rotation regulating portion 3*f*, and therefore, the contact noise attributable to the collision can be reduced.

In this embodiment, as shown in part (a) of FIG. 14, the urging portions 3*g*1, 3*g*2 are provided adjacent to the respective projections 3*c* to which the rotational force is applied. This is because the projections 3*c* is most vulnerable to the rotational force. In other words, the transmission timing of the rotational force is the earliest at the projections 3*c* among the parts of the reciprocating member 3*b*. For this reason, it is preferable that the urging portion 3g1, 3g2 is disposed adjacent to the projection 3c.

As described in the foregoing, by the provision of the urging portions 3g1, 3g2 adjacent to the respective projections 3c, so that the moving speed in the rotational direction of the feeding portion 2k can be reduced, and the contact noise between the reciprocating member 3b and the rotation regulating portion 3f can be reduced.

In this embodiment, two projections 3c at the end portions of the U-shaped reciprocating member 3b, and the same (two) number of urging portions 3g1 and 3g2 are provided. It is preferable that the number of the U-shaped elastic urging portions 3g1, 3g2 is the same or larger than the number of the projections 3c of the reciprocating member 3b.

In this embodiment, as shown in part (a) of FIG. 14, two urging portions 3g1 and 3g2 are provided at the end portions of the U-shaped reciprocating member 3b. Of these urging portions, one urging portion 3g1 of them is disposed in the downstream side (downstream side with respect to the rotational direction) with respect to the rotational moving direction of the reciprocating member 3b (rotational moving direction of the feeding portion 2k), in this example.

Referring to FIG. 16, a developer supplying system including the developer supply container according to the second embodiment of the present invention will be described. In the description of this embodiment, the same reference numerals or parts names as in the first Embodiment are assigned to the elements having the corresponding functions in this embodiment, and the detailed description thereof is omitted for simplicity.

In the first embodiment, of the two urging portions 3g1, 3g2 provided at the end portions of the U-shaped reciprocating member 3b, only one urging portion 3g1 shown at the right side of part (a) of FIG. 14 is disposed in the downstream of the with respect to the rotational moving direction of the reciprocating member 3b (rotational moving direction of the feeding portion 2k). In this embodiment, as shown in FIG. 16, both of the urging portions 3g1 and 3g5 of the U-shaped reciprocating member 3b are disposed in the downstream side with respect to the rotational direction of the reciprocating member 3b (rotational direction of the feeding portion 2k).

FIG. 16 is a schematic perspective view of the structure in which both of the urging portions 3g1 and 3g5 of the reciprocating member 3b are disposed in the downstream side with respect to the rotational direction of the reciprocating member 3b (rotational direction of the feeding portion 2k).

This embodiment is different from the first embodiment in that the positions of the urging portion 3g5 of the reciprocating member 3b is downstream (not upstream) side with respect to the rotational moving direction of the reciprocating member 3b (rotational moving direction of the feeding portion 2k). The structures are substantially similar to those of the first embodiment.

As described in the foregoing, in the first embodiment, the elastic urging portions 3g1, 3g2 wedges in the play between the arm portion 3h of the reciprocating member 3b and the rotation regulating portion 3f, so that the contact noise caused by the contact between the arm portion 3h of the reciprocating member 3b and the rotation regulating portion 3f. Therefore, the width F2 of the arm portion 3h of the reciprocating member 3b including the urging portion 3g1, 3g2 and the width F3 of the rotation regulating portion 3f satisfy F2>F3.

In such a case, however, the arm portion 3h of the reciprocating member 3b including the urging portion 3g1, 3g2 is always in contact with the rotation regulating portion 3f, and therefore, a frictional force when the reciprocating member 3b slides in the rotational axis direction of the feeding portion 2k is large, with the result of possible obstruction to the reciprocation of the reciprocating member 3b.

In this embodiment, the frictional force when the reciprocating member 3b move in the rotational axis direction of the feeding portion 2k is reduced so as to make the reciprocation of the reciprocating member 3b easier.

In this embodiment, the width F2 of the arm portion 3h of the reciprocating member 3b including the elastic urging portion 3g1, 3g5, and the width F3 of the rotation regulating portion 3f satisfy F2<F3. In such a case, too, as shown in FIG. 16, both of the two urging portions 3g1, 3g5 provided at the end portions of the U-shaped reciprocating member 3b are disposed in the downstream side with respect to the rotating direction of the reciprocating member 3b (rotational direction of the feeding portion 2k). By this, the contact noise between the arm portion 3h of the reciprocating member 3b and the rotation regulating portion 3f can be reduced.

More specifically, the width F2 of the arm portion 3h of the reciprocating member 3b including the urging portion 3g1, 3g5 and the width F3 of the rotation regulating portion 3f satisfy F2<F3, and therefore, the reciprocating member 3b is movable in the rotational moving direction of the feeding portion 2k by the amount of the play. The urging portion 3g1, 3g5 is contacted to the rotation regulating portion 3f before the arm portion 3h of the reciprocating member 3b and the rotation regulating portion 3f contact to each other.

As shown in FIG. 16, both of the two urging portions 3g1 and 3g5 provided at the end portions of the U-shaped reciprocating member 3b are disposed in the downstream side (downstream side with respect to the rotational moving direction) with respect to the rotational moving direction of the reciprocating member 3b (rotational moving direction of the feeding portion 2k). By this, before the contact between the arm portion 3h of the reciprocating member 3b excluding the urging portion 3g1, 3g5 and the rotation regulating portion 3f, the contact speed between the arm portion 3h of the reciprocating member 3b and the rotation regulating portion 3f can be reduced, so that the contact noise can be reduced. In this embodiment, the contact portion 3g3, 3g6 contacting with the rotation regulating portion 3f continues to slide on the rotation regulating portion 3f by the urging force of the urging portion 3g1, 3g5.

In this embodiment, the projections 3c of the reciprocating member 3b are fitted in the cam groove 2e, but the similar effects can be provided by the reciprocating member 3b is fitted in a projected configuration cam portion.

As described in the foregoing, in this embodiment, the urging portion 3g1, 3g5 first contacts to the rotation regulating portion 3f. By this, the frictional force when the reciprocating member 3b slides in the rotational axis direction of the feeding portion 2k is reduced as compared with the case of the first embodiment, while reducing the contact noise. By this, the reciprocation of the reciprocating member 3b in the rotational axis direction of the feeding portion 2k is easy. The other structures are similar to those of the first embodiment, and the similar effects can be provided.

INDUSTRIAL APPLICABILITY

The noise produced at the contact portion between the reciprocating member reciprocating to convert the rotational force into the force for operating the pump portion and the regulating portion for regulating the movement of the description reciprocating member in the direction crossing with the reciprocal movement can be reduced.

The invention claimed is:

1. A developer supply container comprising:

a developer accommodating portion configured to accommodate developer;

a developer discharging portion provided with a discharge opening configured and positioned to discharge the developer;

a feeding portion configured and positioned to feed the developer in said developer accommodating portion toward said developer discharging portion with rotation thereof;

a drive receiving portion configured and position to receive a rotational force for rotating said feeding portion;

a pump portion provided to act at least toward said developer discharging portion and having a volume that changes with reciprocation;

a drive converting portion configured and positioned to convert the rotational force input to said drive receiving portion into a force for operating said pump portion;

an arm portion provided at said drive converting portion and reciprocable to convert the rotational force into a force for operating said pump portion;

regulating portions provided at respective sides of said arm portion with respect a crossing direction crossing a direction in which said arm portion reciprocates and configured and positioned to regulate movement of said arm portion in the crossing direction; and an elastically deformable urging portion, provided at one of the sides of said arm portion with respect the crossing direction and configured and positioned to urge the other side of said arm portion that is opposite to the one side of said arm portion toward one of said regulating portions by said urging portion contacting to the other of said regulating portions.

2. A developer supply container according to claim 1, further comprising a second arm portion provided at said drive converting portion and reciprocable to convert the rotational force into the force for operating said pump portion;

second regulating portions provided at respective sides of said second arm portion with respect the crossing direction in which said second arm portion reciprocates and configured and positioned to regulate movement of the second arm portion in the crossing direction; and a second elastically deformable urging portion provided at one of the sides of said second arm portion with respect the crossing direction and configured and positioned to urge the other side of said second arm portion that is opposite to the one side of said second arm portion toward one of said second regulating portions by said second urging portion contacting to the other of said regulating portions.

3. A developer supply container according to claim 1, wherein said urging portion is provided at the position downstream of the one side of the arm portion with respect to a rotational moving direction of said drive receiving portion.

4. A developer supplying system including a developer supplying apparatus and a developer supply container detachably mountable to said developer supplying apparatus, said developer supplying apparatus including:

a mounting portion configured to dismountably mount said developer supply container, a developer receiving portion configured and positioned to receive developer from said developer supply container, and a driving portion configured and positioned to apply a driving force to said developer supply container; and said developer supply container including:

a developer accommodating portion configured and positioned to accommodate the developer;

a feeding portion configured and positioned to feed the developer in said developer accommodating portion toward said developer discharging portion with rotation thereof;

a drive receiving portion configured and position to receive a rotational force for rotating said feeding portion;

a pump portion provided to act at least toward said developer discharging portion and having a volume that changes with reciprocation;

a drive converting portion configured and positioned to convert the rotational force input to said drive receiving portion into a force for operating said pump portion;

an arm portion provided at said drive converting portion and reciprocable to convert the rotational force into a force for operating said pump portion;

regulating portions provided at respective sides of said arm portion with respect a crossing direction crossing a direction in which said arm portion reciprocates and configured and positioned to regulate movement of said arm portion in the crossing direction; and an elastically deformable urging portion, provided at one of the sides of said arm portion with respect the crossing direction and configured and positioned to urge the other side of said arm portion that is opposite to the one side of said arm portion toward one of said regulating portions by said urging portion contacting to the other of said regulating portions.

5. A developer supplying system according to claim 4, wherein said developer supply container further comprises:

a second arm portion provided at said drive converting portion and reciprocable to convert the rotational force into the force for operating said pump portion;

second regulating portions provided at respective sides of said second arm portion with respect the crossing direction in which said second arm portion reciprocates and configured and positioned to regulate movement of the second arm portion in the crossing direction; and a second elastically deformable urging portion provided at one of the sides of said second arm portion with respect the crossing direction and configured and positioned to urge the other side of said second arm portion that is opposite to the one side of said second arm portion toward one of said second regulating portions by said second urging portion contacting to the other of said regulating portions.

6. A developer supplying system according to claim 4, wherein said urging portion is provided at the position downstream of the one side of the arm portion with respect to a rotational moving direction of said drive receiving portion.

* * * * *